US012774863B2

(12) United States Patent
Jordan

(10) Patent No.: US 12,774,863 B2
(45) **Date of Patent: *Oct. 27, 2026**

(54) JAM-RESISTANT DRUM MAGAZINE

(71) Applicant: Jordan Automated Weapons System, LLC, Cedar City, UT (US)

(72) Inventor: Ben Rich Jordan, Cedar City, UT (US)

(73) Assignee: JORDAN AUTOMATED WEAPONS SYSTEM, LLC, Cedar City, UT (US)

( * ) Notice: Subject to any disclaimer, the term of this patent is extended or adjusted under 35 U.S.C. 154(b) by 0 days.

This patent is subject to a terminal disclaimer.

(21) Appl. No.: 19/212,514

(22) Filed: May 19, 2025

(65) Prior Publication Data

US 2026/0016249 A1 Jan. 15, 2026

Related U.S. Application Data

(63) Continuation of application No. 18/768,525, filed on Jul. 10, 2024, now Pat. No. 12,305,953.

(51) Int. Cl.
*F41A 9/75* (2006.01)

(52) U.S. Cl.
CPC ..... *F41A 9/75* (2013.01)

(58) Field of Classification Search
CPC ..... F41A 9/03; F41A 9/26; F41A 9/73; F41A 9/74; F41A 9/75
See application file for complete search history.

(56) References Cited

U.S. PATENT DOCUMENTS 1,042,241 A * 10/1912 Lissack ..... F41A 9/74 89/33.02
1,293,396 A * 2/1919 Fox ..... F41A 3/40 89/33.02
1,330,873 A * 2/1920 Hulse ..... F23K 3/00 89/33.02
1,462,852 A * 7/1923 Dawson ..... F41A 9/26 89/33.02
1,563,052 A * 11/1925 Vollmer ..... F41A 9/73 89/33.02

(Continued)

FOREIGN PATENT DOCUMENTS

DE 2326542 1/1974
DE 2326542 A1 * 1/1974

(Continued)

*Primary Examiner* — Gabriel J. Klein
(74) *Attorney, Agent, or Firm* — David R. Conklin; Kirton McConkie

(57) ABSTRACT

Jam-resistant drum magazines and related methods are disclosed. In some implementations, a jam-resistant drum magazine includes a drum, which may have a base, a body, and a top. Some implementations of the drum include a tiered component having a platform extending from a support, and some implementations have a channeled component having a channel configured to receive a round of ammunition. Some implementations include a transition drum, which may have a cylinder with a chamber configured to receive the round of ammunition from the channel. In some implementations, the tiered component is configured to rotate with respect to the channeled component, thereby causing the round of ammunition to move along the platform toward the transition drum.

19 Claims, 17 Drawing Sheets

(56) References Cited

U.S. PATENT DOCUMENTS 1,629,652 A * 5/1927 Browning ..... F41A 9/26
89/33.02
1,811,694 A * 6/1931 Larsson ..... F41A 9/74
89/33.02
2,113,793 A * 4/1938 Larsson ..... F41A 9/74
89/33.02
2,407,461 A * 9/1946 Vesely ..... F41A 9/74
89/33.02
2,833,182 A * 5/1958 Houston ..... F41A 9/74
89/33.02
3,319,523 A * 5/1967 Casull ..... F41A 19/33
89/33.02
3,427,923 A * 2/1969 Meyer ..... F41A 9/74
89/33.02
3,800,658 A * 4/1974 Hougland ..... F41A 9/74
89/33.02
4,166,408 A * 9/1979 Wetzel ..... F41A 9/04
89/33.02
4,344,350 A * 8/1982 Golden ..... F41A 9/51
198/594
4,457,208 A * 7/1984 Golden ..... F41A 9/74
89/33.02
4,524,673 A * 6/1985 Golden ..... F41A 9/74
89/33.02
4,962,604 A * 10/1990 Miller ..... F41A 9/77
89/33.02
5,561,258 A * 10/1996 Bentley ..... F41A 9/75
89/33.02
8,291,806 B2 * 10/2012 Rael ..... F41A 9/75
89/33.02
2011/0078937 A1 * 4/2011 Rich ..... F41A 9/73
89/33.1
2015/0176935 A1 * 6/2015 Wei ..... F41A 9/73
89/33.02

FOREIGN PATENT DOCUMENTS

GB 190913846 A * 6/1910 ..... F41A 9/74
GB 125632 A * 5/1919 ..... F41A 9/83
GB 245026 A * 12/1925 ..... F41A 9/73

* cited by examiner

JAM-RESISTANT DRUM MAGAZINE

RELATED APPLICATION

This application is a continuation of U.S. patent application Ser. No. 18/768,525, filed on Jul. 10, 2024, which issued as U.S. Pat. No. 12,305,953, on May 20, 2025, which is incorporated herein by reference.

FIELD

The present disclosure relates to weapons systems, and more particularly to drum magazines.

BACKGROUND

Loading and supplying ammunition to a firearm continues to be one of the greatest challenges for providing fast and efficient automatic weapons systems. One method of rapidly delivering ammunition includes providing drum magazines.

Traditional drum magazines, however, have several shortcomings. For example, existing drum magazines face reliability issues, like being prone to jamming and malfunctioning, especially when loaded to full capacity. Jamming is an especially large setback, as drum magazines are intended to allow for rapid firing and minimal delay. A jam can not only take anywhere from several seconds to several minutes to clear, but those moments can cost lives and determine the outcome of key strategic battles. One particular reason that existing drum magazines frequently jam is that the rounds of ammunition have a tendency to line up on one another (e.g., the primer of one round gets caught on the primer of another). Traditional drum magazines have no mechanism in place to prevent this from occurring.

Relatedly, traditional drum magazines typically require regular cleaning and maintenance to ensure proper functioning. Loading a traditional drum magazine can also be challenging, time-consuming, and noisy. It can, in some cases, require extensive training and a great degree of manual dexterity. These challenges make use of traditional drum magazines undesirable in many situations in which they would otherwise be extremely useful.

As another drawback, drum magazines are often bulky and heavy, making them uncomfortable to carry and maneuver. Many drum magazines are not adaptable to different kinds of ammunition, and thus have limited applicability.

Thus, while some types of drum magazines may be useful in certain situations, challenges still exist, including those listed above. Accordingly, it would be an improvement in the art to augment or even replace current techniques with other techniques.

BRIEF SUMMARY

Systems and methods for providing a jam-resistant drum magazine are disclosed. Some implementations of the drum magazine include a drum having a base, a body, and a top.

In some implementations, the drum includes a tiered component having at least one platform extending from a support. In some cases, the drum includes a channeled component having at least one channel configured to receive at least one round of ammunition.

According to some implementations, the tiered component is structured such that the platform extends around an entire perimeter of the support. For example, the platform may extend from the support in a spiral, thereby forming a plurality of interconnected ascending platform tiers (with a gap between each tier). Additionally, in some implementations of the channeled component, the channel has a cross section with a shape that is similar to the shape of a round of ammunition. For example, in some cases the channeled component has multiple channels separated from each other by dividers, and each channel is configured to receive multiple rounds of ammunition. In some implementations, the channeled component and the tiered component are disposed in proximity to one another (e.g., the tiered component is placed within the channel component or vice versa), with the channel facing the platform. Thus, a round of ammunition can be disposed at least partially within the channel and at least partially within the gap between tiers of the platform. Indeed, multiple rounds can be disposed within a single channel and separated from each other by the platform's tiers. Thus, each round of ammunition can have its own personal pocket or space formed of the interaction between the channeled component and the tiered component.

Some implementations of the drum magazine include at least one transition drum, which may include at least one cylinder (e.g., a cylinder like the cylinder of a revolver—not necessarily a cylindrically shaped component). The cylinder may have one or more chambers configured to receive the round of ammunition from the channel. In some implementations, the tiered component is configured to rotate with respect to the channeled component, and the rotation of the tiered component with respect to the channeled component causes the round of ammunition to move along the platform (e.g., up the spiral) toward the transition drum.

In some cases, the transition drum further includes a cylinder housing. The cylinder may be disposed (e.g., entirely, or at least partially) within the housing and be configured to rotate within the cylinder housing. In some cases, the cylinder is configured to rotate within the cylinder housing in response to the round of ammunition entering the chamber of the cylinder (e.g., the momentum of the round entering the chamber causes the cylinder to rotate to the next position, whereupon an additional round can enter the next empty chamber). Some implementations of the transition drum are configured to deliver the round to the firearm (e.g., by coupling to the firearm in a similar manner as a traditional magazine coupling to such firearm). Additionally, in some implementations the transition drum is angled with respect to the drum such that the rounds of ammunition do not contact one another (thereby eliminating opportunities for jamming). For example, in some cases the angle of the transition drum causes the primer of one round of ammunition in the cylinder to be offset from (e.g., in front of or behind, as opposed to flush with) the primer of another round.

In some implementations, the drum has an actuator configured to drive the rotation of the tiered component with respect to the channeled component. For example, in some cases the actuator includes a spring, such as a spiral torsion spring. The actuator may be housed within an actuator housing (e.g., a spring housing disposed in the base of the drum). Some implementations of the drum magazine-particularly where a spring is used for the actuator-include a winder configured to wind the spring. In some cases, the winder is selectively insertable into the drum (e.g., it can be used to wind the spring when needed, and removed when winding is not required, thereby not getting in the way). When the winder is inserted into the drum, the winder can engage with the spiral torsion spring allowing it to be wound.

Some implementations of the drum magazine include at least one brake for inhibiting the rotation of the tiered component with respect to the channeled component. In some cases, the brake inhibits the rotation bidirectionally (e.g., the tiered component cannot rotate with respect to the channeled component at all, either clockwise or counter-clockwise), and in some cases the brake inhibits the rotation unidirectionally (e.g., only clockwise or only counter-clockwise). Thus, for example, the brake can prevent the spring from unwinding while the drum magazine is loaded, but the spring may still be wound with the brake engaged. In some cases, the brake is configured to toggle between inhibiting the rotation either bidirectionally or unidirectionally, at a user's option. It some cases, the brake includes at least one ratchet and at least one pawl configured to engage with a tooth of the ratchet.

In some implementations, each of the plurality of rounds of ammunition in the drum is allowed to rotate as it is pushed along the ascending spiral of the platform towards the transition drum, such that the casing of each of the plurality of rounds of ammunition functions as a bearing to decrease a resistance of the rotation of the tiered component with respect to the channeled component.

These are just a few examples of the wide range of features available in connection with the present invention. Thus, the related systems and methods are disclosed in further detail below.

BRIEF DESCRIPTION OF THE DRAWINGS

The objects and features of the present disclosure will become more fully apparent from the following description and appended claims, taken in conjunction with the accompanying drawings. Understanding that these drawings depict only typical embodiments of the disclosed systems and methods and are, therefore, not to be considered limiting of its scope, the systems and methods will be described and explained with additional specificity and detail through the use of the accompanying drawings in which:

DETAILED DESCRIPTION

A description of embodiments will now be given with reference to the Figures. It is expected that the present systems and methods may take many other forms and shapes, hence the following disclosure is intended to be illustrative and not limiting, and the scope of the disclosure should be determined by reference to the appended claims.

Embodiments of the present invention are directed at systems and methods relating to drum magazines, and in particular, improved drum magazines that are jam-proof or jam-resistant. Jamming is a large problem in the overall drum magazine industry, so the systems and methods provided herein can greatly increase the efficacy of firearms utilizing drum magazines as disclosed herein.

Figure 1:
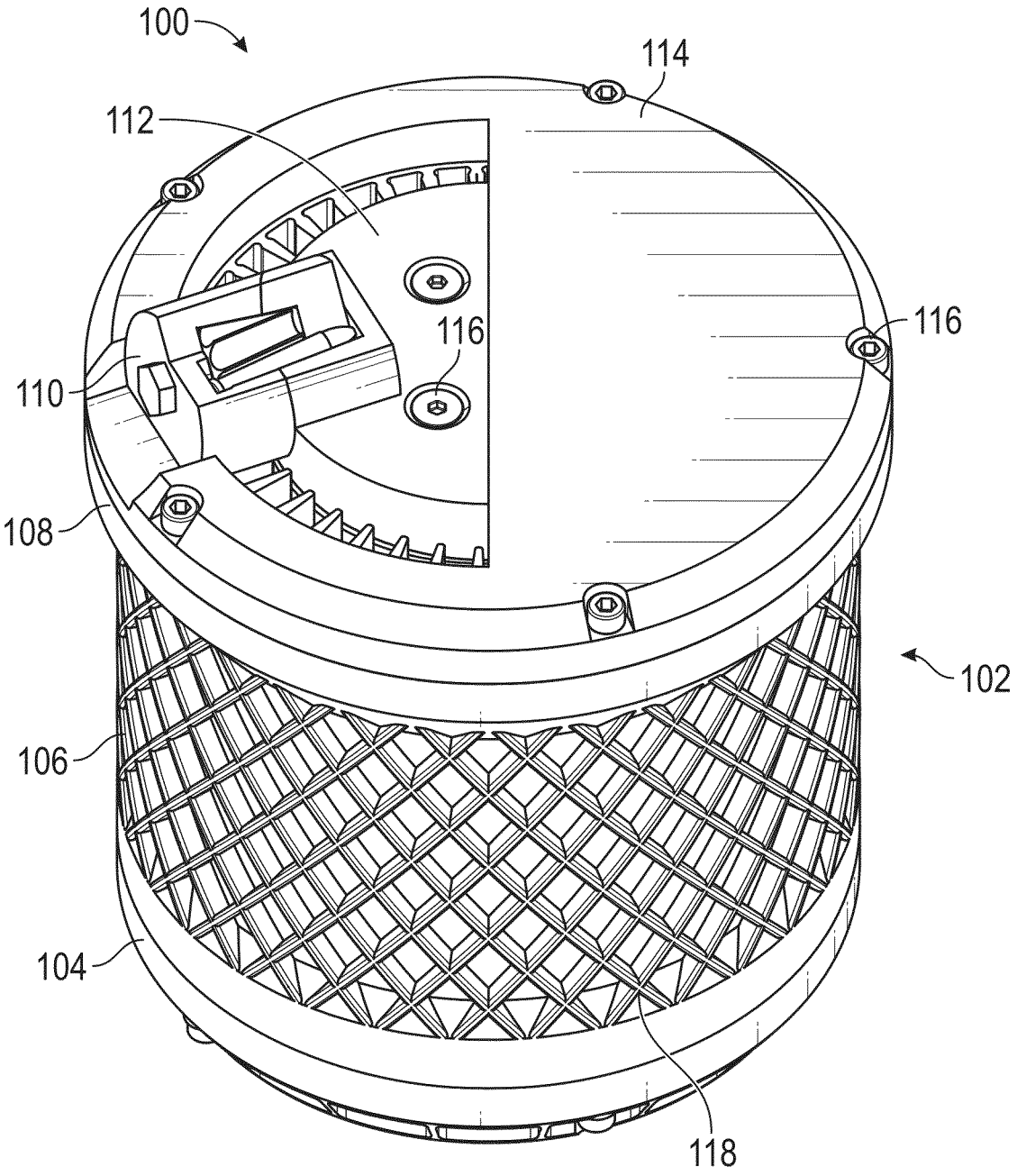
FIG. 1 shows a top perspective view of a drum magazine, in accordance with a representative embodiment of the disclosed systems and methods.

With reference generally to FIG. 1, some embodiments of the drum magazine 100 include one or more drums 102. Some embodiments of the drum 102 have one or more of a base 104, a body 106, and a top 108. It is important to note that use of the drum magazine 100 is not limited to any particular spatial orientation (e.g., it can be used right-side-up, on its side, upside down, or at any other orientation). Accordingly, the terms "top," "body," and "base," along with other terms like "vertical," "horizontal," and "lateral" are used for convenience and are generally intended to be interpreted with respect to the drum magazine 100 as a whole (unless the context indicates otherwise). For example, some embodiments of the drum magazine 100 may move rounds of ammunition in a generally upward direction, a generally downward direction, a generally sideways direction, or another direction with respect to gravity, but the term "top" may nonetheless refer to the portion of the drum magazine toward which the rounds are being moved (e.g., in embodiments configured to move rounds towards the top).

Some embodiments of the drum 102 are generally cylindrical, but the drum 102 can have any suitable dimensions. For example, in some embodiments the height can be increased or decreased to accommodate a different number of rounds or different types (e.g., caliber) of rounds. By way of non-limiting illustration, some embodiments of the drum 102 have a height of between 1 cm (e.g., to accommodate a single row of rounds) and 2 meters (e.g., to accommodate hundreds of rows of rounds) or any subrange thereof (e.g., 1 m±0.4 m, 0.6 m±0.3 m, 0.5 m±0.1 m, or any other subrange between 1 cm and 2 m). Similarly, in some embodiments the radius of the drum 102 can be increased or decreased to accommodate a different number of rounds or different types of rounds. In some embodiments, the radius may be between 5 cm and 1 m, or any subrange thereof (e.g., 0.3 m±0.2 m, 0.2 m±0.1 m, 0.175 m±0.025 m, or any other subrange between 5 cm and 1 m). Generally speaking, the drum 102 may have a radius sufficient, when used in connection with a certain type of ammunition, to allow each round of ammunition to be closely spaced with, but not contacting, adjacent rounds (e.g., within 0.1 mm to 10 cm of other rounds, or any subrange thereof). In some cases, the radius is optimized so that the rounds of ammunition are evenly spaced from one another along a length of the rounds. For example, many types of ammunition are thicker at the primer (in the back) and thinner at the bullet (in the front), and some embodiments of the drum are sized so as to position the primer of one round approximately the same distance from the primer of another round as the bullet of the round is placed from the bullet of the other round (e.g., the difference between the distance at the backs of the rounds and the distance at the fronts of the rounds may be within 0.1 mm to 10 cm or any subrange thereof). In short, the drum 102 can be configured to hold any number of any type of round, such as between 10 and 100,000 rounds or any subrange thereof (e.g., 1,000±500, 700±300, 500±100, 560 precisely, or any other range between 10 and 100,000).

With further reference to FIG. 1, some embodiments include a transition drum 110. As discussed in more detail later, the transition drum can include any component configured aid in transferring ammunition from the drum 102 to a firearm (e.g., to the magazine well of the firearm). In some embodiments, the transition drum 110 is located at the top 108 of the drum 102 (although it can also be located in any other location with respect to the drum 102).

Some embodiments of the transition drum 110 are integrated with or otherwise coupled to a top plate 112, a lid 114, or both. The top plate 112 and the lid 114 may each include any component configured to reinforce, anchor, or cover another portion of the drum magazine 100. In some embodiments, the top plate 112 is configured to attach to an inner portion of the drum 102 (as discussed in more detail below). The top plate 112 can have any suitable geometry (e.g., it can be circular, square, rectangular, triangular, or form any other polygon or shape), but in some cases it is generally semi-circular, having an edge that abuts an edge of the lid 114. In some cases, the radius of the semicircle of the top plate 112 is less than the radius of the drum 102, such that a portion of the drum (e.g., an outer portion, in which rounds of ammunition are partially housed) is exposed (thereby allowing a user to visually determine whether the drum is running low on ammunition). Similarly, the lid 114 may have any geometrical configuration, but in some embodiments it is generally circular (e.g., to cover or substantially cover the drum 102. In some embodiments, the lid 114 includes a window (which also may have any geometric shape, but in some cases is semi-circular or arched shape) for accommodating the top plate 112, allowing visual access to a portion of the drum 102, or accommodating the transition drum 110. Notwithstanding the foregoing, some embodiments include only one of either the lid 114 or the top plate 112 (which in some cases may fulfill the role of both components). In some embodiments, substantially all of the top 108 of the drum 102 is covered by the lid 114 (and/or the top plate 112). In some embodiments, the window includes glass, plastic, or another transparent or translucent material, allowing a user to see into the drum 102 while the covering is still in place.

The top plate 112, the lid 114, and many other components of the drum magazine 100 as discussed herein may be configured to be coupled together. In this regard, components configured to couple together may be coupled together in any suitable manner (e.g., welded, glued, integrally formed, secured with a coupler, etc.). This notwithstanding, in some embodiments, various components are coupled together through the use of one or more fasteners. Fasteners may include one or more nails, screws, bolts, staples, eyelets, magnets, hook-and-loop fasteners, adhesives, welds, interference fits, friction fits, tongue-and-groove connections, snaps, ties, rivets, stakes, wire ties, holes for receiving fasteners, or any other couplers. By way of non-limiting illustration, FIG. 1 shows a top plate 112 having a pair of bolts as fasteners 116 anchoring it to the drum 102, and a lid 114 with fasteners 116 radially spaced around a perimeter to couple the lid to a rim at the top 108 of the drum 102.

In some embodiments, the drum 102 includes one or more shells 118. The shell 118 may include any component configured to provide any or all of the following to the drum 102: a surface more suitable for gripping (by humans, by machinery, or otherwise); better temperature regulation (e.g., for dissipating heat generated by the operation of the drum magazine 100, or for providing insulation if needed); better aesthetics or a different look (e.g., camouflage for a tactical advantage); armor, protection, support, or reinforcement (to prevent against impacts, cracking, or other damage); a surface that may be fixed in place while a portion of the drum rotates; or any other property useful for a shell 188. In some embodiments, the shell 118 is integrally formed with the drum 102, but in some embodiments it is separately formed, interchangeable, or selectively removable.

Figure 2:
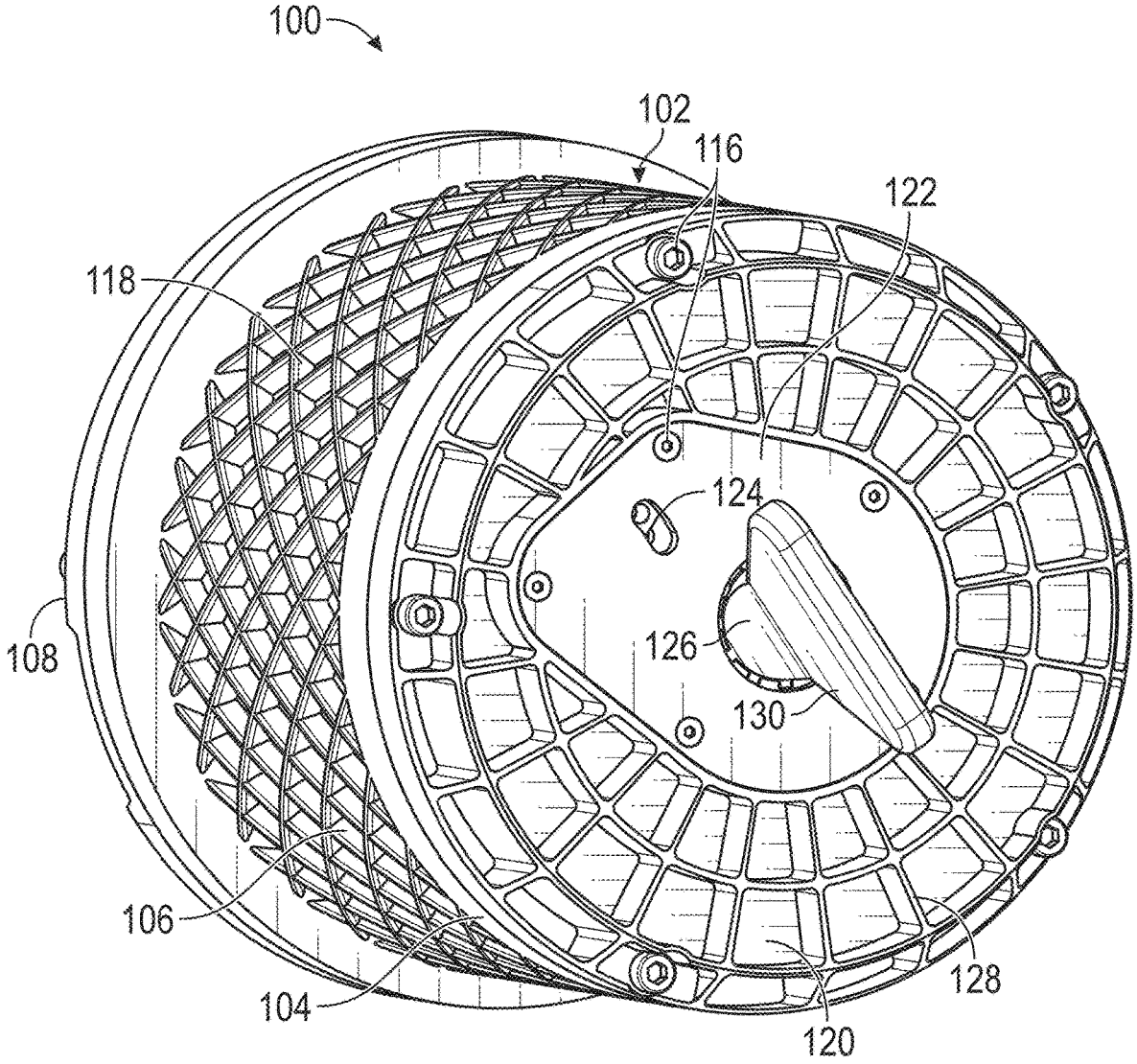
FIG. 2 shows a bottom perspective view of a drum magazine, in accordance with a representative embodiment.

Referring now to FIG. 2, FIG. 2 provides a better view of the base 104 of a drum magazine 100 in accordance with some embodiments of the instant systems and methods. In some embodiments, the base 104 includes a bottom 120 (which may be somewhat analogous to the lid 114 of the top 108). The bottom 120 may have any geometrical configuration, but in some embodiments it is configured to cover (or substantially cover) the base 104. For example, the bottom 120 may be generally circular. In some embodiments, the bottom 120 is permanently or semi-permanently attached to the base 104, and in some embodiments it is selectively removable (in either case, the bottom 120 may be attached via fasteners 116).

In some embodiments, the bottom 120 includes a base plate 122. The base plate may be coupled to the bottom 120 (e.g., via fasteners 116), and may include any component useful for providing access to the mechanisms within the drum 102 (and particularly within the base 104).

In some embodiments, the base plate 122 includes an access port 124 (e.g., for accessing an activator, as discussed in more detail later, or for accessing any other component of the drum magazine 100). Some embodiments of the base plate 122 include a passage through which a winder 126 may extend or be inserted. Some embodiments of the bottom 120 may include a bottom shell 128, which may be the same as, similar to, or different from the shell 118, and which may perform the same, similar, or different functions. In some embodiments, the bottom shell 128 includes an indentation configured to accommodate the transition drum 110 of another drum magazine 100 when stacked, or other features that allow multiple drum magazines 100 to easily be stacked on top of each other.

As briefly mentioned previously, some embodiments of the drum magazine 100 include a winder 126. The winder 126 can include any component configured to prepare an actuator to operate the drum magazine 100. In this regard, many embodiments utilize a coil spring or another mechanical actuator (as discussed in more detail below) that may require mechanical winding or other mechanical preparation. That said, some embodiments utilize another type of actuator, such as an electric or gas-powered motor. In such cases, the winder 126 can include an electric charger, a gas pump, or another component as may be required to prepare the actuator for operation.

In some embodiments in which the actuator requires mechanical preparation, the winder 126 is configured to supply mechanical power, such as through turning of the winder 126. Accordingly, some embodiments of the winder 126 include a handle 130. The handle 130 may include any type of handle, such as a grip configured to enable a human to manually wind the actuator, a tool attachment to allow for automatic winding (e.g., using a drill or a specialized winder), or any other feature to allow for the desired mechanical power to be provided. In some embodiments, the handle 130 (alone or together with other portions of the winder 126) is selectively removable (e.g., operating like a key that can be inserted when needed and removed when the drum magazine 100 is loaded and winded and ready for use). In some embodiments, the handle 30 is configured to fold down, telescope, or otherwise be adjusted to be out of the way. In some embodiments, the base plate 122 includes a slot for the handle 130 when the handle 130 is in a folded or stowed configuration. In some embodiments, the bottom 120 includes a feature to retain the handle 130 (e.g., a pocket, a clip, a slot, or another retaining feature) when the handle is removed from the passage.

Figure 3:
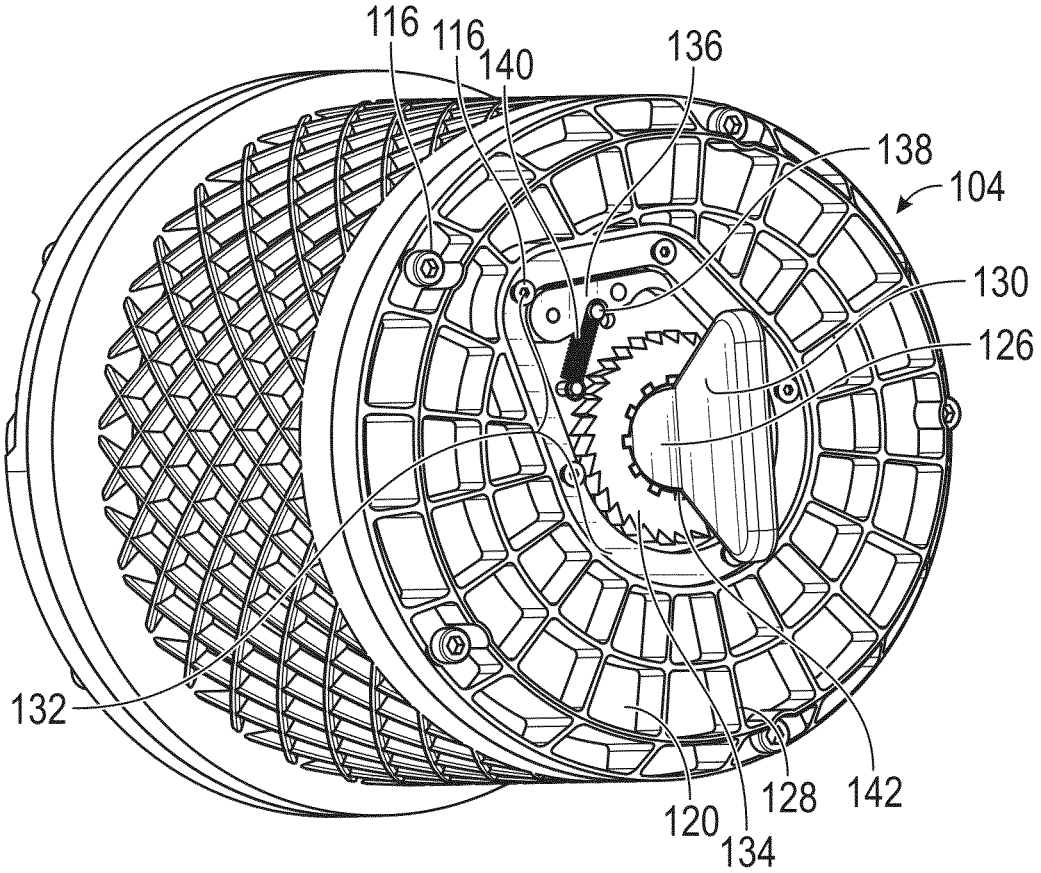
FIG. 3 shows a bottom perspective view of a drum magazine, with a base plate removed to reveal interior components, in accordance with a representative embodiment.

FIG. 3 shows the base 104 of the drum 102 with the base plate removed. In this regard, some embodiments of the drum 102 include one or more braking systems ("brake(s)") 132. Although FIG. 3 shows the brake 132 as part of the base 104, it is important to note that the brake 132, like the winder 126, can also be incorporated into or used with any other part of the drum magazine 100. The brake 132 can include any component configured to stop or impede operation of the drum 102. In this regard, some embodiments of the drum 102 are configured such that an inner portion of the drum 102 rotates with respect to an outer portion of the drum 102 (e.g., as driven by the actuator, and as will be discussed in more detail hereinafter). Accordingly, some embodiments of the brake 132 are configured to prevent or limit such rotation. In some embodiments, the brake prevents the rotation bidirectionally (e.g., it prevents or limits the inner portion from rotating with respect to the outer portion in either a clockwise or a counterclockwise direction). However, in some embodiments, the brake prevents or limits rotation (with respect to the other component) only unidirectionally (e.g., only in a clockwise direction or only in a counterclockwise direction). This allows, for example, the actuator to be wound while the brake 132 prevents unwinding until the brake 132 is disengaged and the drum magazine 100 is allowed to operate. In some embodiments, the brake may prevent or limit rotation bidirectionally or unidirectionally at the user's option (e.g., by toggling between two different modes).

The brake 132 can include any braking mechanism for stopping or limiting the action of the drum magazine 100 (e.g., disc brakes, drum brakes, hydraulic brakes, ABS brakes, cantilever brakes, brake pads, coaster brakes, air brakes, or any other type of brakes). By way of non-limiting illustration, as shown in FIG. 3, some embodiments of the brake 132 include one or more ratchets 134 (or cogwheels) and one or more pawls 136. In some cases, the pawl includes a pivoted curved or straight bar having a free end, and the ratchet 134 includes gear-like teeth with which the free end of the pawl is configured to engage. In some cases, the teeth are angled such that the pawl 136 engages with them only unidirectionally, thereby effectively preventing the ratchet 134 from rotating in an undesirable (e.g., unwinding) direction while the brake 132 is engaged, but still allowing rotation in a desirable direction (e.g., winding) even when the brake 132 is engaged (and requiring the brake 132 to be disengaged before rotation in the other direction can occur). In some embodiments, the pawl 136 is biased toward the ratchet 134 when the brake 132 is engaged. While it can be biased in any suitable manner, in some embodiments this is accomplished through use of a spring, such as a coil spring 140. In this regard, the coil spring 140 pulls the pawl 136 toward the ratchet 134, causing it to engage with the teeth of the ratchet 134, but still allowing for the ratchet 134 to be turned in the allowable direction by stretching the coil spring 140.

Some embodiments of the brake 132 include one or more activators 138. The activator can include any component configured to engage or disengage the brake 132 (e.g., a switch, a lever, a toggle, a button, a peg, or any other electronic or mechanical mechanism for engaging and disengaging the brake 132). In some embodiments, the activator 138 is accessible through the access port 124 of the base plate 122 (although in some embodiments, the activator 138 is positioned in another location on the drum magazine 100). In some embodiments, the activator 138 is configured to be activated remotely, such as through a remote control or a computer (e.g., mobile) application. Some embodiments of the activator 138 include a protruding component (e.g., a peg, a pin, or another protrusion) coupled to the pawl 136 and a pair of indentations configured to receive the protruding component, wherein when the protruding component is positioned within a first indentation, the pawl 136 is biased against the ratchet 134, and when the protruding component is positioned within a second indentation, the pawl 136 is not biased against the ratchet 134. In some embodiments, the protruding component is configured to slide or shift between the indentations in response to movement from a user's finger. However, in some embodiments, a tool is required to engage or disengage the brake 132.

Figure 4:
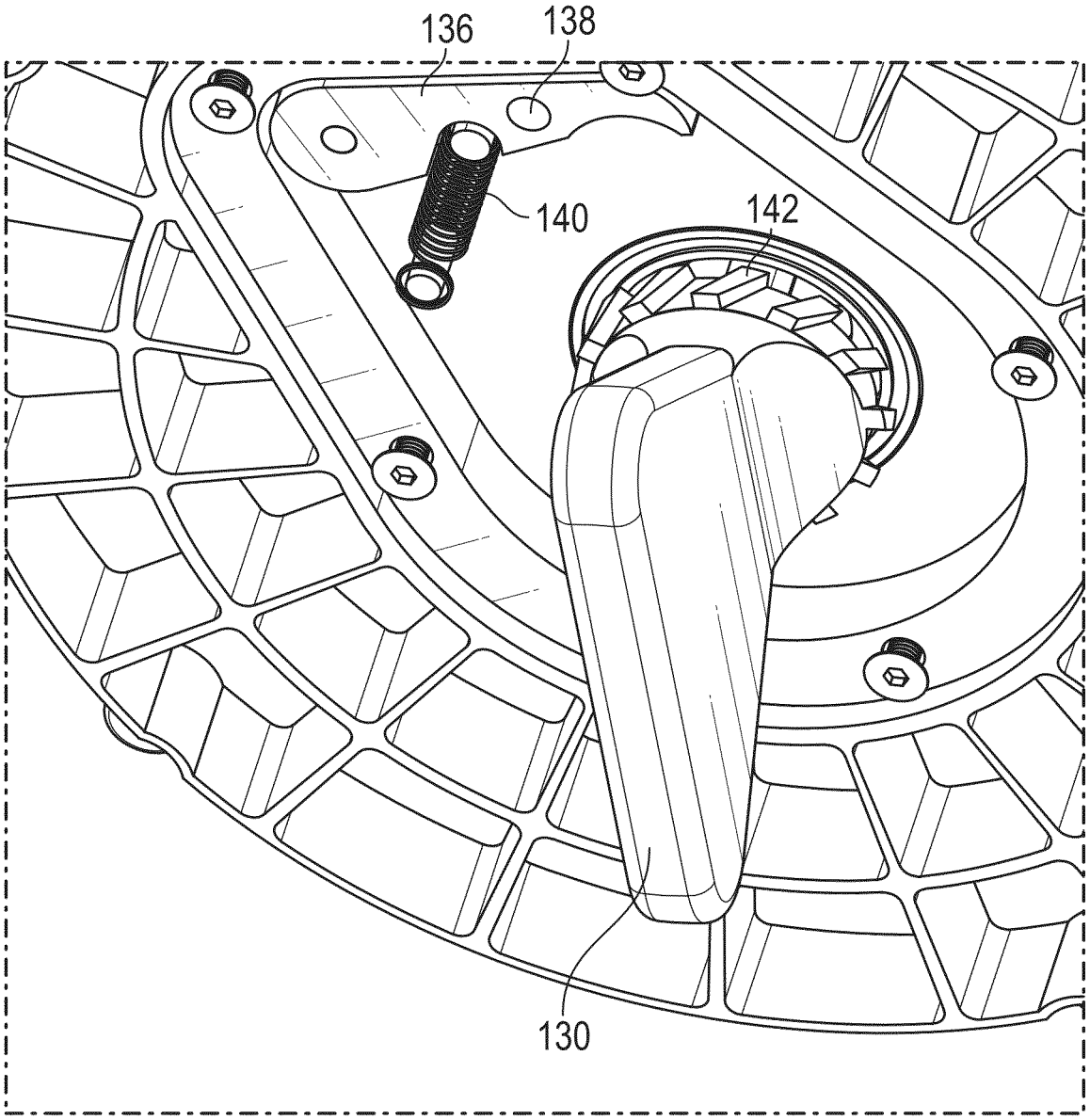
FIG. 4 shows a perspective view of a winder of a drum magazine without an accompanying ratchet, in accordance with a representative embodiment.

In some embodiments, the handle 130 of the winder 126 is configured to (permanently or selectively) interface with the brake 132. By way of example, as shown in FIG. 3, some embodiments of the winder 126 include a gear 142 with teeth configured to interface with grooves in the ratchet 134. Thus, when the handle 130 of the winder 126 is turned, the ratchet 134 is similarly rotated. In some embodiments, if the user so desires, the gear 142 can be pulled out of the ratchet 134 so the handle 130 can be withdrawn. That said, as shown in FIG. 4, some embodiments of the gear 142 include angled teeth (to be inserted into similarly angled slots in the ratchet 134) to make inadvertent disassociation of the handle 130 from the ratchet 134 less likely to occur (e.g., because in such a configuration, the handle must be properly twisted and pulled outward simultaneously in order to be withdrawn). In some embodiments, the teeth of the gear 142 are angled (from the portion most medial to the handle 130 to the portion most distal to the handle 130) in a direction that is the same as the direction which the brake allows the ratchet 134 to turn when the pawl 136 is engaged, thereby requiring a user to turn the handle 130 in the opposite direction (against the brake 132) to withdraw the handle.

Figure 5:
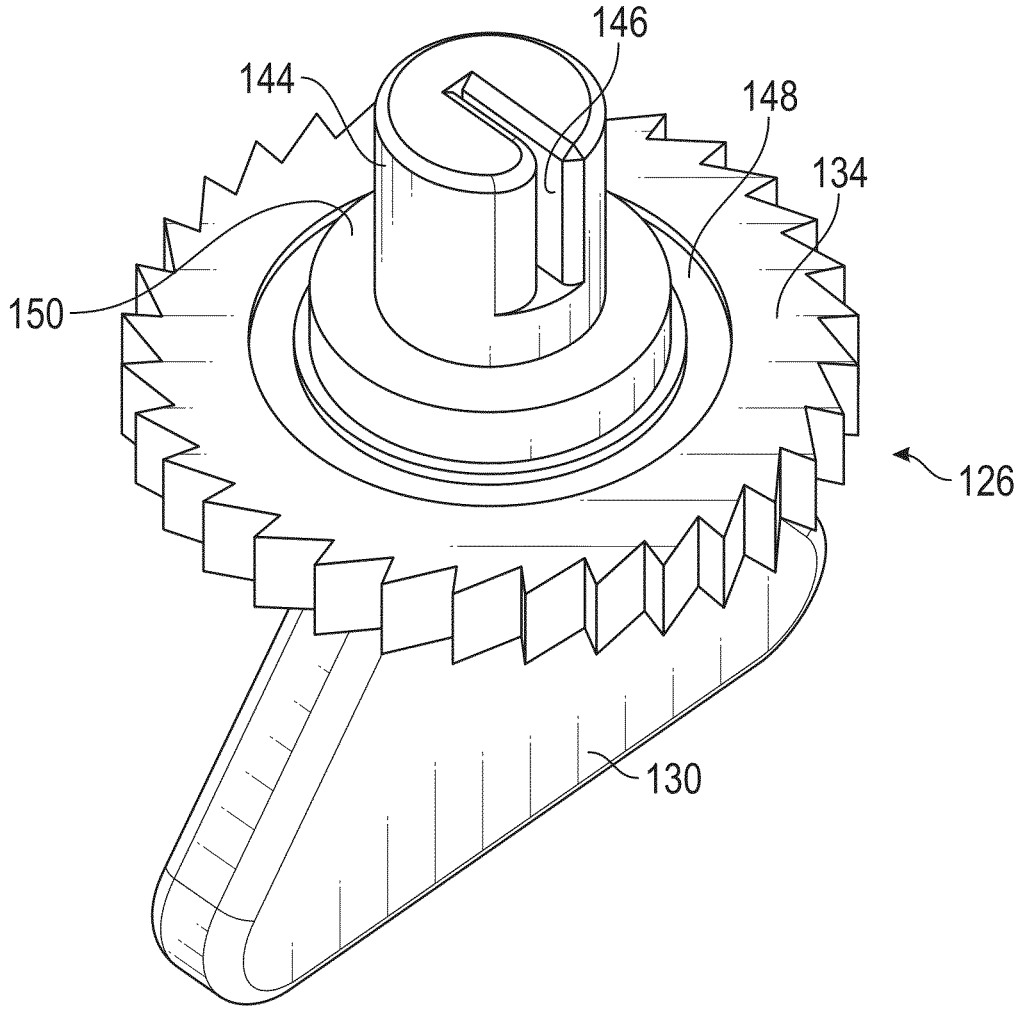
FIG. 5 shows an inverted perspective view of a winder of a drum magazine, in accordance with a representative embodiment.

Turning now to FIG. 5, some embodiments of the winder 126 include a shaft 144 (which may be fixedly coupled with the handle 130), which in some embodiments is configured to be inserted through the ratchet 134. In some embodiments, the shaft 144 is integrally connected with the ratchet 134. In some embodiments, the shaft 144 includes a retainer 146 configured to interface with the actuator. For example, where the actuator includes a spiral torsion spring (as discussed below), the retainer 146 may retain an end of the spiral torsion spring such that when the shaft 144 is rotated, the spring is wound. In some embodiments, the shaft 144 is selectively detachable from the handle 130 (e.g., when the handle 130 is withdrawn). In some embodiments, the shaft is fixedly connected to the actuator (e.g., the end of the spiral torsion spring). That said, in some embodiments, the whole winder 126, including the shaft 144, may be withdrawn along with the handle 130.

Figure 6:
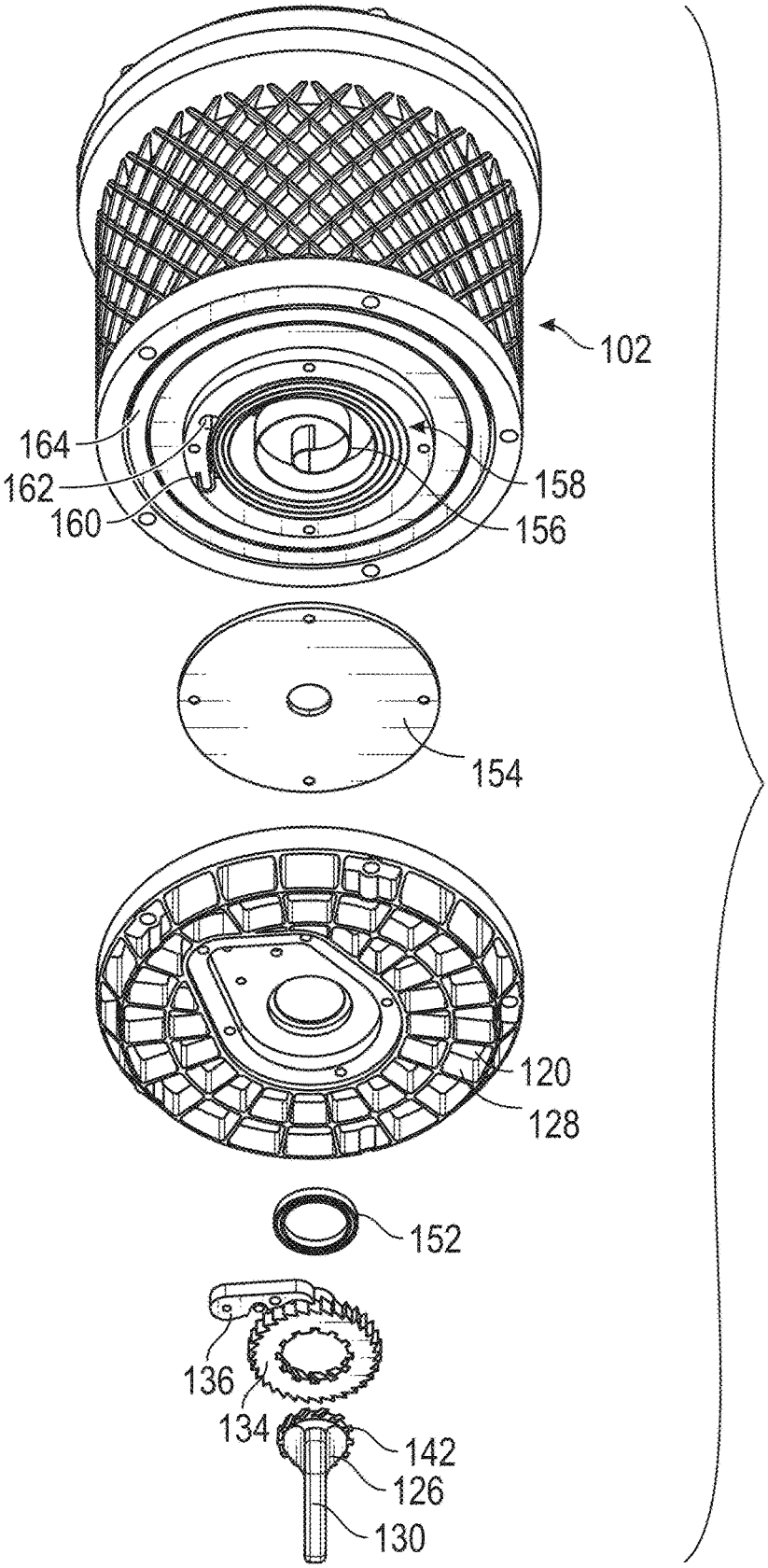
FIG. 6 shows a bottom perspective exploded view of a base of a drum magazine, in accordance with a representative embodiment.

In some embodiments, the winder 126 includes one or more grooves 148 configured to receive a winder bearing (e.g., 152 of FIG. 6). This may allow the winder 126 to turn with less undesirable resistance. In some embodiments, the groove 148 is recessed in the ratchet 134, whereas in some embodiments the groove 148 may be recessed in a portion of the base 104 of the drum 102. In some embodiments, the winder 126 includes one or more flanges 150 configured to interface with complementary recesses in the base 104 of the drum 102 to provide a snug fit for the winder 126.

FIG. 6 shows an exploded view of the base 104 of the drum 102. In addition to the components previously discussed (e.g., the bottom 120, the bottom shell 128, the winder 126, the handle 130, the ratchet 134, the pawl 136, the gear 142, and the bearing 152), FIG. 6 shows additional components included in some embodiments (which may be included in the base 104 or elsewhere within the drum 102). For example, some embodiments include a spring cover 154 configured to cover one or more spiral torsion springs 156 (or other actuators) by acting as a lid for a spring housing 158. The spring cover 154 may include a passage formed therethrough to allow the shaft 144 (see FIG. 5) to interface with an end of the spiral torsion spring 156. The spiral torsion spring 156 and other related components are better seen in FIG. 7.

Figure 7:
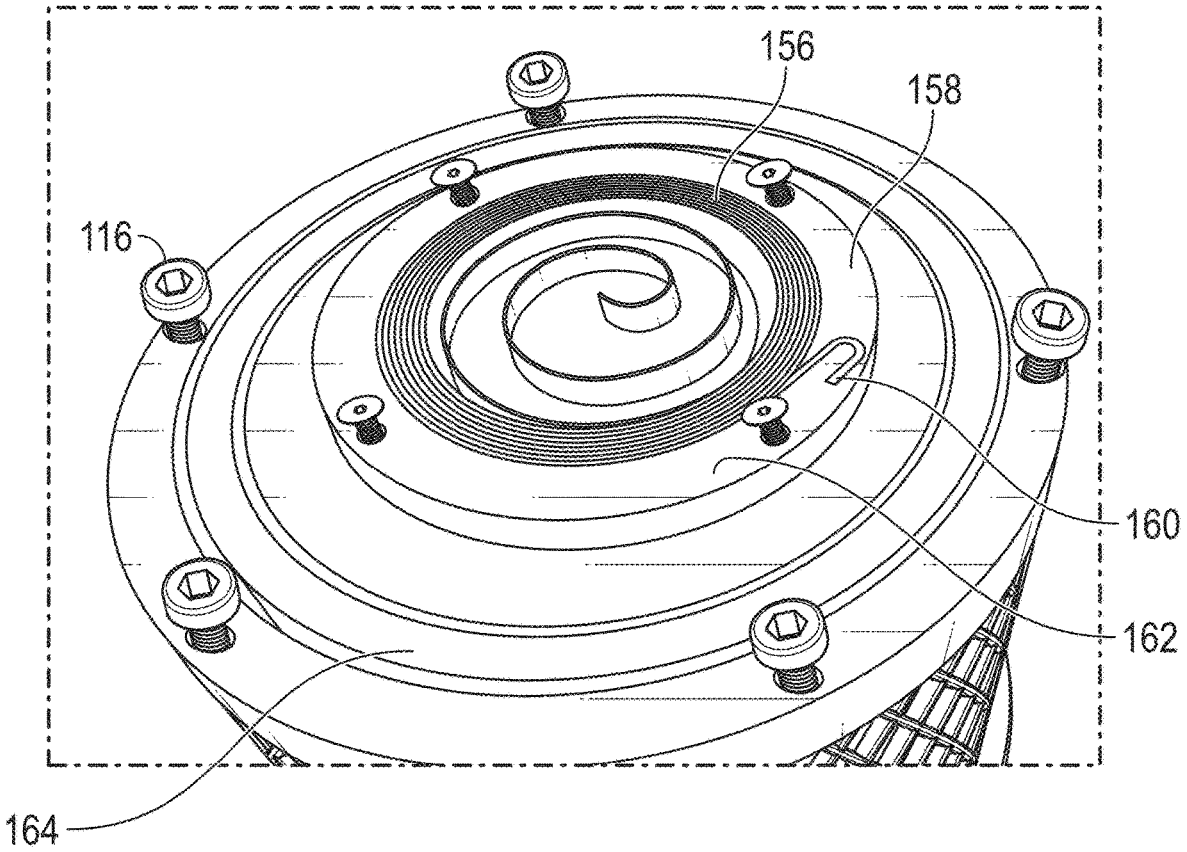
FIG. 7 shows a perspective cutaway view of a base of a drum magazine, in accordance with a representative embodiment.

As shown in FIG. 7, some embodiments include a spiral torsion spring 156 disposed within the spring housing 158. Again, other actuators may be used in place of the spiral torsion spring 156, but a spiral torsion spring 156 has several advantages, such as smooth and quiet winding and unwinding, the ability to use it repeatedly without degradation of performance, and the ability to use it without relying on an external power source. Additionally, by naturally exerting rotational torque force, the spiral torsion spring 156 easily causes the components of the drum 102 to rotate with respect to each other in a manner that is unlikely to cause a jam (and otherwise creates the desired results with high fidelity). The spiral torsion spring 156 can include any type of torsion spring or other similar spring, such as back-to-back or tandem mounted dual (or more) torsion springs (which may be wound in the same or opposite directions), laminar mounted torsion springs with multiple springs interwound, cavity mounted springs, single spiral springs, double spiral springs, flat wire coil springs, or other similar springs of any size, strength, style, or gauge.

In some embodiments, the spiral torsion spring 156 is configured to fit entirely within the spring housing 158. Additionally, as with other coupling components, the spring cover 154 (as shown in FIG. 6) may couple to the spring housing 158 via one or more fasteners 116 (as shown in FIG. 7), and the spiral torsion spring 156 may therefore be secured within the base 104 between the bottom 120 and the body 106 of the drum 102.

Figure 8:
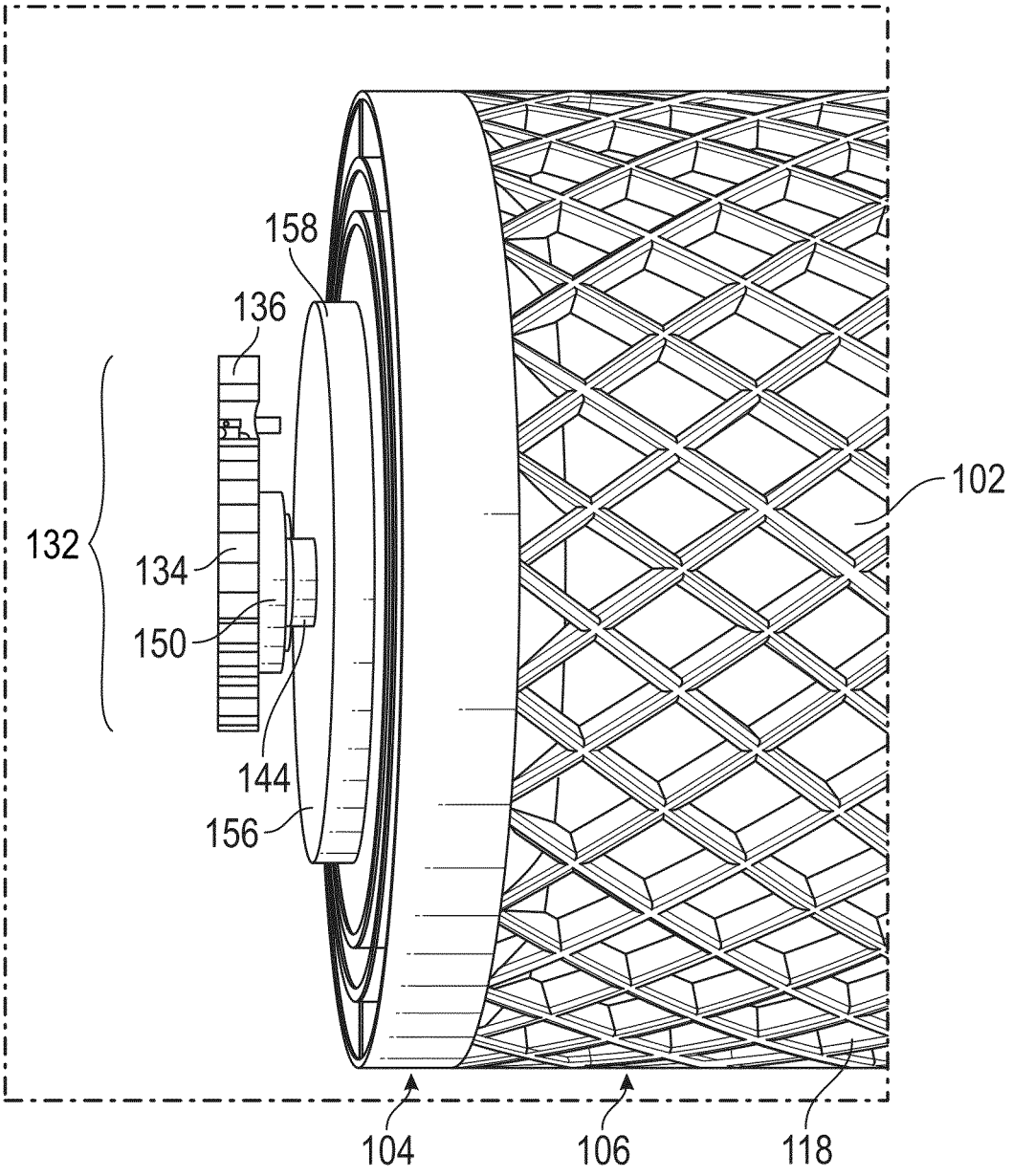
FIG. 8 shows a side elevation cutaway view of a base of a drum magazine, in accordance with a representative embodiment.

According to some embodiments, the spring housing 158 includes a spring stop 160. The spring stop 160 can include any component for retaining the spiral torsion spring 156 in a particular position or for coupling the spiral torsion spring 156 to the spring housing 158 (for example, the spring stop 160 may include any type of fastener). That said, in some embodiments the spring stop 160 includes a groove or a curved recess allowing an outer end of the spiral torsion spring 156 that doubles back on itself to be retained in place. Meanwhile, an inner end of the spiral torsion spring 156 may be configured to couple to the shaft 144 of the winder 126, thereby allowing for winding of the spiral torsion spring 156. The interaction of the winder 126 (including a brake 132 having a ratchet 134 and a pawl 136 for preventing unwinding) with the spiral torsion spring 156, in accordance with some embodiments, is shown in FIG. 8. As the spiral torsion spring 156 is coupled to the shaft 144 (in some embodiments), the spring winds and unwinds only as the winder 126 allows (in such embodiments).

With reference again to FIG. 7, some embodiments of the spring housing 158 include an access slot 162. The access slot 162 can include any feature allowing for easier access to the actuator (e.g., the spiral torsion spring 156). For example, the access slot 162 can include a recess or indentation allowing a user to insert a finger or a tool between the actuator and the spring housing 158 to remove or replace the actuator.

In some embodiments, various portions of the spiral torsion spring 156 or the spring housing 158 are coupled to various components of the drum 102. For example, an outer portion of the spiral torsion spring 156 or the spring housing 158 may be coupled to an outer portion of the drum 102, and an inner portion may be coupled to an inner portion of the drum 102. Similarly, in some embodiments where a different kind of actuator is used, a portion of the actuator is coupled to an outer portion of the drum 102 and another portion is coupled to an inner portion of the drum 102, thereby allowing the outer portion of the drum 102 to rotate with respect to the inner portion of the drum 102. Some embodiments include a drum bearing 164 configured to allow the outer portion of the drum 102 to more easily rotate with respect to the inner portion of the drum 102. It is important to note that either the outer portion or the inner portion (or both) can be the portion that actually rotates, depending on the desired configuration (as discussed in more detail below), but rotation of either (independently of the other) qualifies as rotation with respect to the other. Accordingly, the actuator can be coupled to the drum 102 in any manner that effectuates rotation of either the inner portion of the drum or the outer portion of the drum (or both portions in opposite directions), as long as the portions rotate with respect to each other. In some embodiments, more specific configurations are implemented (e.g., where the inner portion remains fixed relative to the shell 118, the transition drum 110, the bottom 120, or another component, but rotates with respect to the outer portion (e.g., because the outer portion is driven to rotate, or driven to rotate in the opposite direction as the inner portion, by the actuator)).

Figure 9:
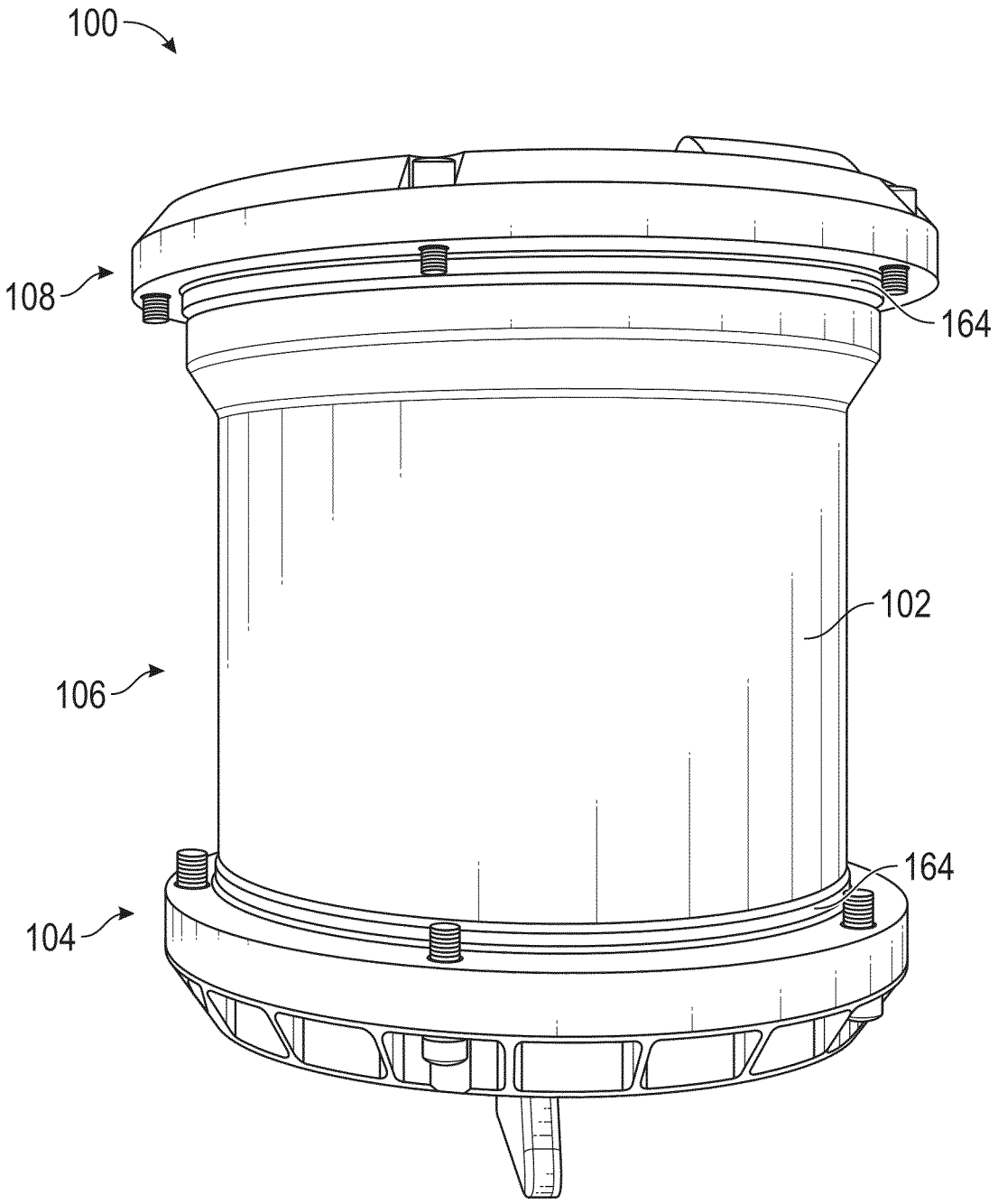
FIG. 9 shows a side elevation view of a drum magazine without a shell, in accordance with a representative embodiment.

The inner and outer portions of the drum 102, which in some embodiments are configured to rotate with respect to one another, will now be explained. Some embodiments of the drum magazine 100 include a drum 102, which may have a body 106 that includes an outer portion (as seen in FIG. 9). The outer portion, in some embodiments, is disposed between the base 104 and the top 108 of the drum. In some embodiments, drum bearings 164 are included between the outer portion and the base 104 and the between the outer portion and the top 108, which may allow the outer portion to rotate smoothly with respect to the base 104 or the top 108 (or an inner portion, as discussed below).

With reference generally to FIGS. 10-14, some embodiments of the drum 102 include a channeled component 166 and a tiered component 172, each of which may be cylindrical or substantially cylindrical. In this regard, either the outer portion of the drum 102 or the inner portion of the drum 102 can include the channeled component 166 or the tiered component 172, but for ease of reference the Figures consistently illustrate the outer portion of the drum 102 as including the channeled component 166 and the inner portion of the drum 102 as including the tiered component. Thus, when the outer portion rotates with respect to the inner portion, the channeled component 166 rotates with respect to the tiered component 172.

Figure 10:
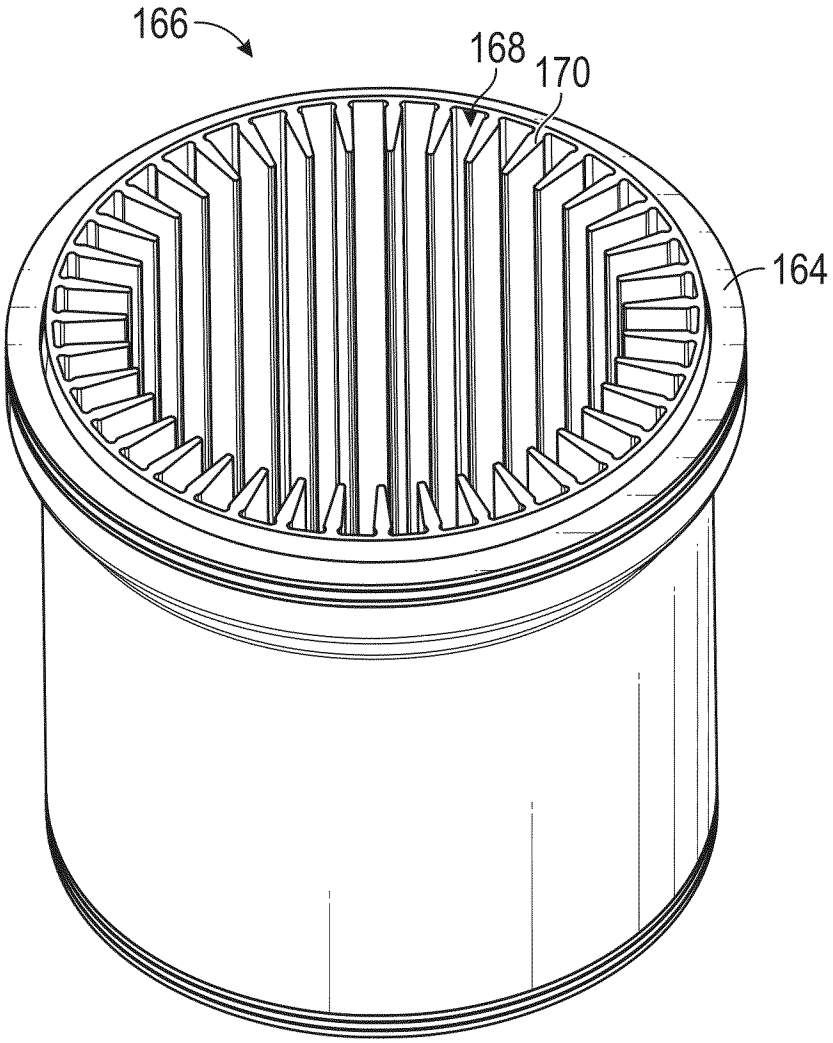
FIG. 10 shows a top perspective view of a channeled component of a drum magazine, in accordance with a representative embodiment.

As seen in FIG. 10, some embodiments of the channeled component 166 include one or more channels 168. In some embodiments, the channels 168 extend vertically (or substantially vertically) down a height of the body 106 of the drum 102. In some embodiments, the channels 168 extend down the entire height of the body 106, whereas some embodiments extend only partway down. Although the channels 168 can have any configuration (curved, wavy, etc.), some embodiments of the channels 168 are substantially straight. This allows rounds of ammunition to freely move up and down in the channels 168 (e.g., in a direction extending between the base 104 and the top 108), while being prevented from moving laterally with respect to the channeled component 166. In some embodiments, the channels 168 are closed at a first end and open at a second end (allowing rounds of ammunition to move in and out of the channels 168 at the open end). Additionally, in some embodiments, the channels 168 have an open face, thereby allowing rounds to protrude from the channels 168 at the open face). In some embodiments, the closed face is configured to receive a primer (see the primer (204) of the round of ammunition (200) of FIG. 16) of a round of ammunition, while the bullet-end of the round is configured to protrude from the open face. Where the channeled component 166 is included in the outer portion of the drum 102, the open face may face inward, while the closed face is disposed proximate to the circumference of the drum 102 (causing the bullets to face inward). Where the channeled component 166 is included in the inner portion, the position of the closed and open faces may be reversed (causing the bullets to face outward).

In some embodiments, the channeled component 166 includes one or more dividers 170 separating the channels 168 from each other. In some embodiments, the channels 168 are defined by the dividers 170. The dividers 170 can include any component for separating the channels, but in some embodiments, the dividers 170 include elongated barriers, which may extend vertically (or substantially vertically) along all or part of the height of the body 106 of the drum 102. While the dividers 170 may have any suitable cross-sectional shape for forming channels that accommodate ammunition, in some embodiments, a cross section of a divider 170 is tapered. For example, a divider 170 may be tapered in an inward direction (with a thicker seat that tapers to a thinner point) if the channeled component 166 is included in an outer portion of the drum 102, or in an outward direction (with a thicker tip and a thinner seat) if the channeled component 166 is in an inner portion of the drum 102. In some embodiments, the dividers 170 include indentations near the seat, forming a slightly wider portion of the channels 168 near the seat to accommodate the primers of rounds of ammunition.

In some embodiments, as a result of the configuration of the dividers 170, a cross section of the channels 168 has a shape that resembles the shape of a round of ammunition (e.g., at least the rear portion of the round, with a substantially cylindrical body portion and a thicker primer portion). In some embodiments, the dividers 170 prevent the rounds of ammunition from moving laterally both concentrically with respect to the channeled component 166 (e.g., in a circular motion along an arc of the drum 102) and radially with respect to the channeled component 166 (e.g., towards or away from a center line of the drum 102)—while nonetheless allowing latitudinal movement (e.g., up and down) with respect to the channeled component 166 along the channels 168 (in some embodiments).

Figure 11:
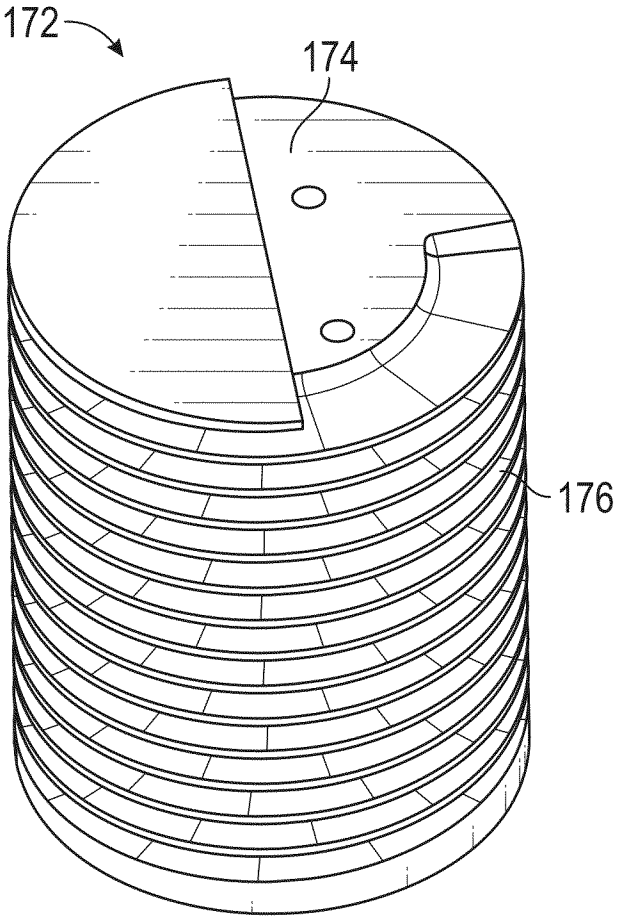
FIG. 11 shows a top perspective view of a tiered component of a drum magazine, in accordance with a representative embodiment.

As seen in FIG. 11, some embodiments of the drum 102 include a tiered component 172 (which is generally shown in the Figures as being part of the inner portion of the drum 102, but which may also be switched with the channeled component 166 to form the outer portion). According to some embodiments, the tiered component includes a platform 176 having at least one tier. In some embodiments, the platform 176 extends from a support 174. The support 174 can have any suitable dimensions. For example, the support 174 can be any height, but in some embodiments it extends along an entire height of the body 106 of the drum 102. In some embodiments, the support extends less than the entire height of the body 106 (e.g., saving room for additional features), or more than the entire height of the body 106 (e.g., extending into or past the base 104 or the top 108). The support 174 can also have any suitable diameter (e.g., between 1 mm and 2 m, or any subrange thereof), but in some embodiments the diameter of the support is less than a diameter of the platform 176 (e.g., such that the platform 176 extends out past the support 174). In some embodiments (e.g., where the tiered component 172 is included in the inner portion of the drum 102), the diameter of the support 174 is less than a distance between the center of the support 174 and the tip of a round of ammunition loaded into the drum 102. In some embodiments, the support 174 is solid, but in some embodiments the support 174 includes a hollow cavity. This can (a) decrease the weight of the drum magazine 100; (b) provide a location for storing extra ammunition, spare parts or other supplies; or (c) contain additional features (e.g., a sound dampening mechanism, a light, or another additional feature). Where the tiered component 172 is included in the inner portion of the drum 102, the platform 176 may extend radially outward from the support 174, and when the tiered component 172 is included in the outer portion of the drum 102, the platform 176 may extend radially inward from the support 174.

In some embodiments, the platform 176 of the tiered component 172 extends from the support 174 in a spiral (either a right-handed spiral or a left-handed spiral), thereby forming a plurality of tiers. In some embodiments, the tiers are separated by a gap. The gap may have any suitable dimensions (e.g., it may have a height of anywhere between 1 mm and 100 cm, or any subrange thereof), but in some embodiments, the gap is sufficient to fit a portion of a round of ammunition extending from a channel 168 of the channeled component 166. In some embodiments, the gap has a height of within 15% or less (e.g., 10%, 5%, 1%, etc.) of the diameter of the applicable round of ammunition. Additionally, the platform can have any slope that allows it to form a tiered configuration with space for rounds of ammunition, but in some cases a minimal slope is desired (as this makes it easier for rounds to travel up and along the platform towards the top 108). In some embodiments, the slope of the spiral is uniform.

Figure 12:
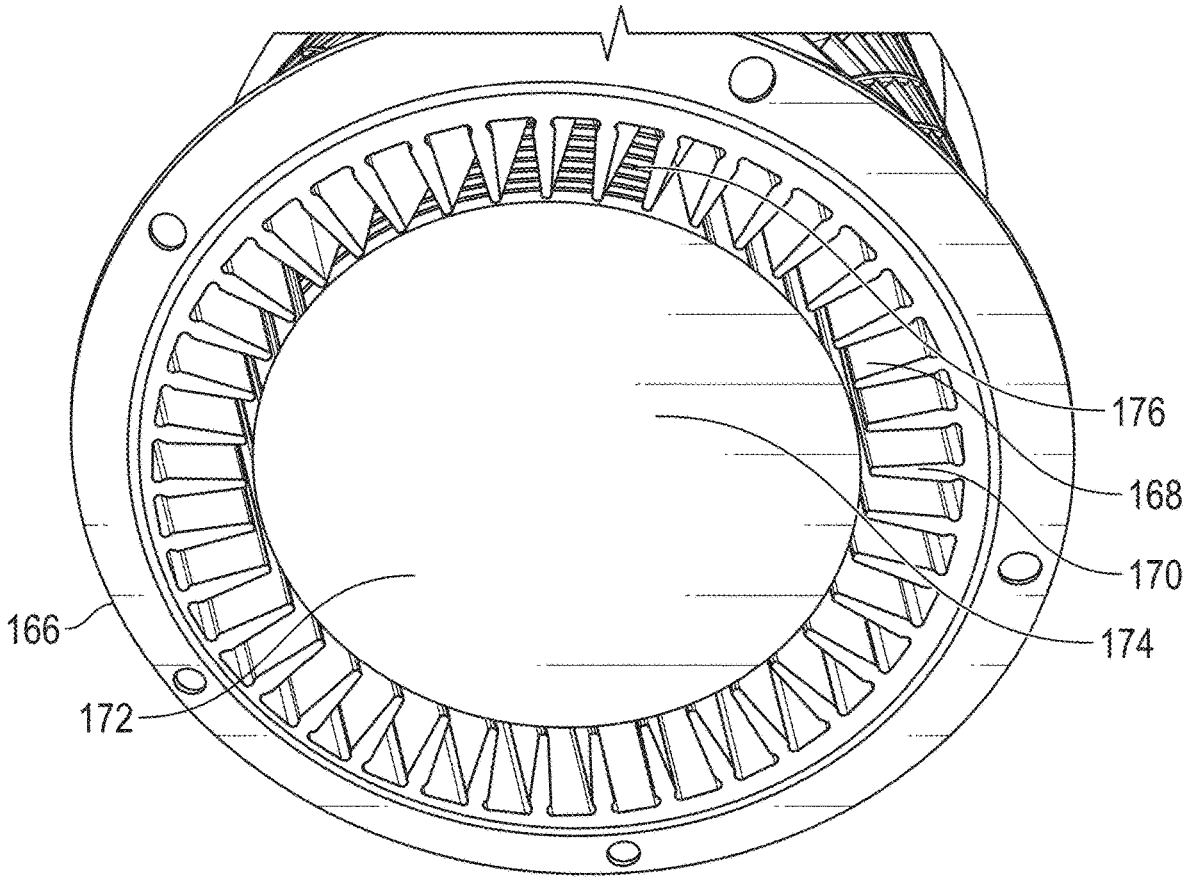
FIG. 12 shows a cross-sectional perspective view of a drum of a drum magazine, in accordance with a representative embodiment.

As shown generally in FIG. 12, in some embodiments the platform 176 and accompanying gap of the tiered component 172 is configured to face the channels 168 and accompanying dividers 170 of the channeled component 166. For example, where the inner portion of the drum 102 includes the tiered component 172 and the outer portion includes the channeled component 166 (as illustrated in FIG. 12), the platform 176 may face radially outward away from the center of the drum 102 and the channels 168 may face radially inward toward the center of the drum 102. Conversely, where the outer portion of the drum 102 includes the tiered component 172 and the inner portion includes the channeled component 166, the platform 176 may face radially inward toward the center of the drum 102 and the channels 168 may face radially outward away from the center of the drum 102. In either case, some embodiments are configured such that the interaction between the tiered component 172 and the channeled component 166 forms a plurality of individual spaces for rounds of ammunition. In some embodiments, the spaces are configured to prevent individual rounds of ammunition from contacting each other, while still remaining in close proximity (e.g., within a distance of 10-100%, or any subrange thereof, of the diameter of a single round) to one another.

Figure 13:
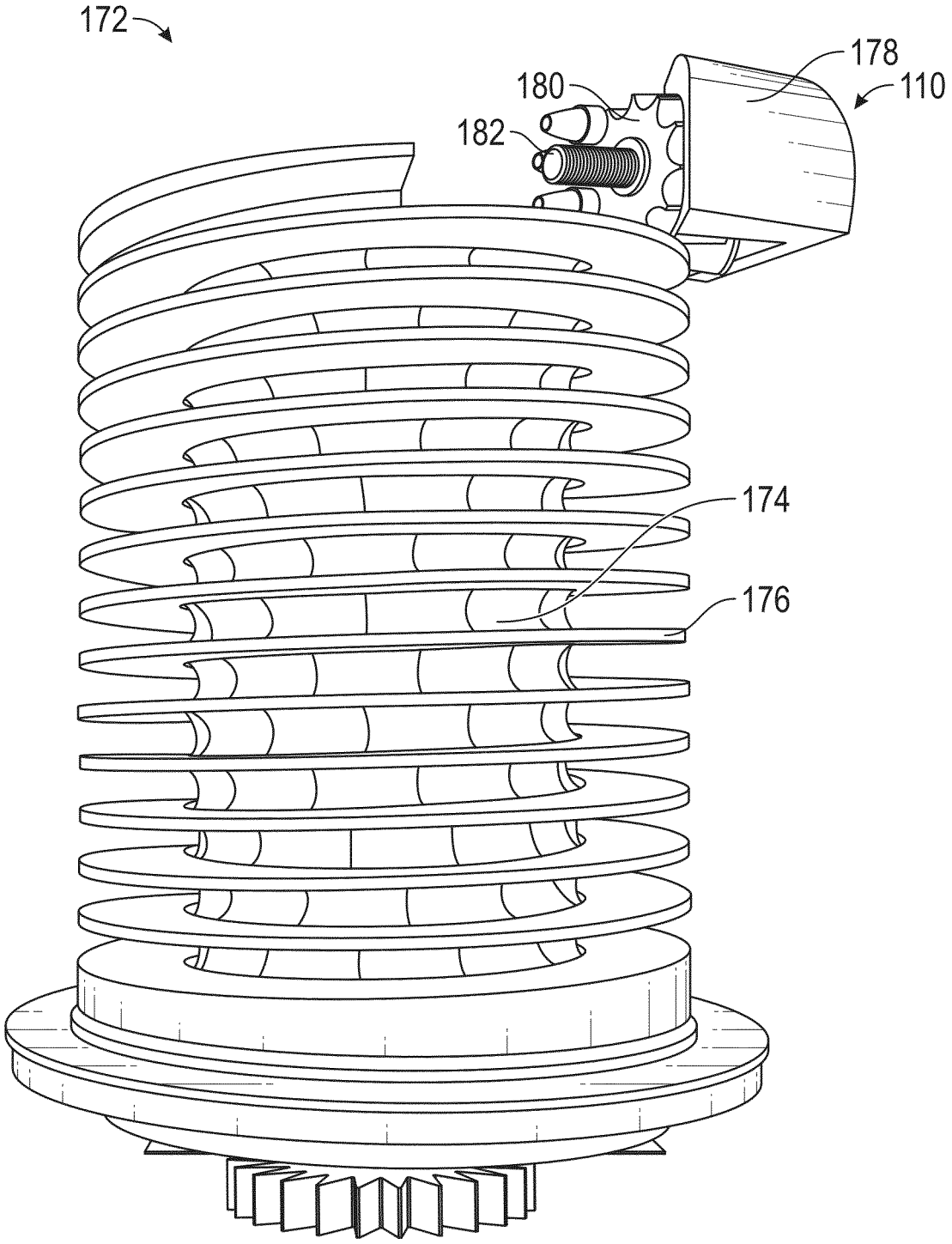
FIG. 13 shows a side elevation of a tiered component of a drum magazine in relation to a transition drum, in accordance with a representative embodiment.
Figure 14:
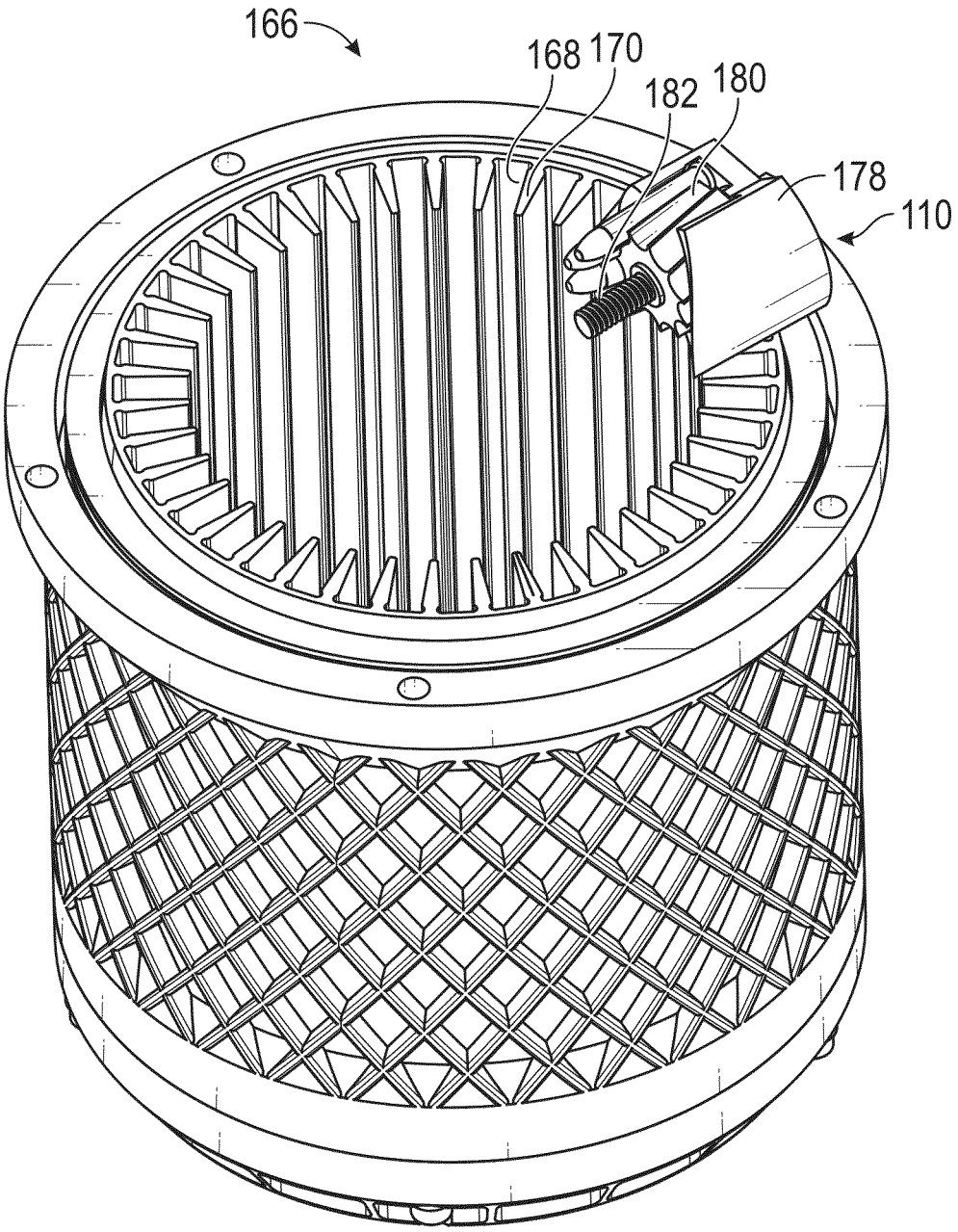
FIG. 14 shows a top perspective view of a channeled component of a drum magazine in relation to a transition drum, in accordance with a representative embodiment.
Figure 15:
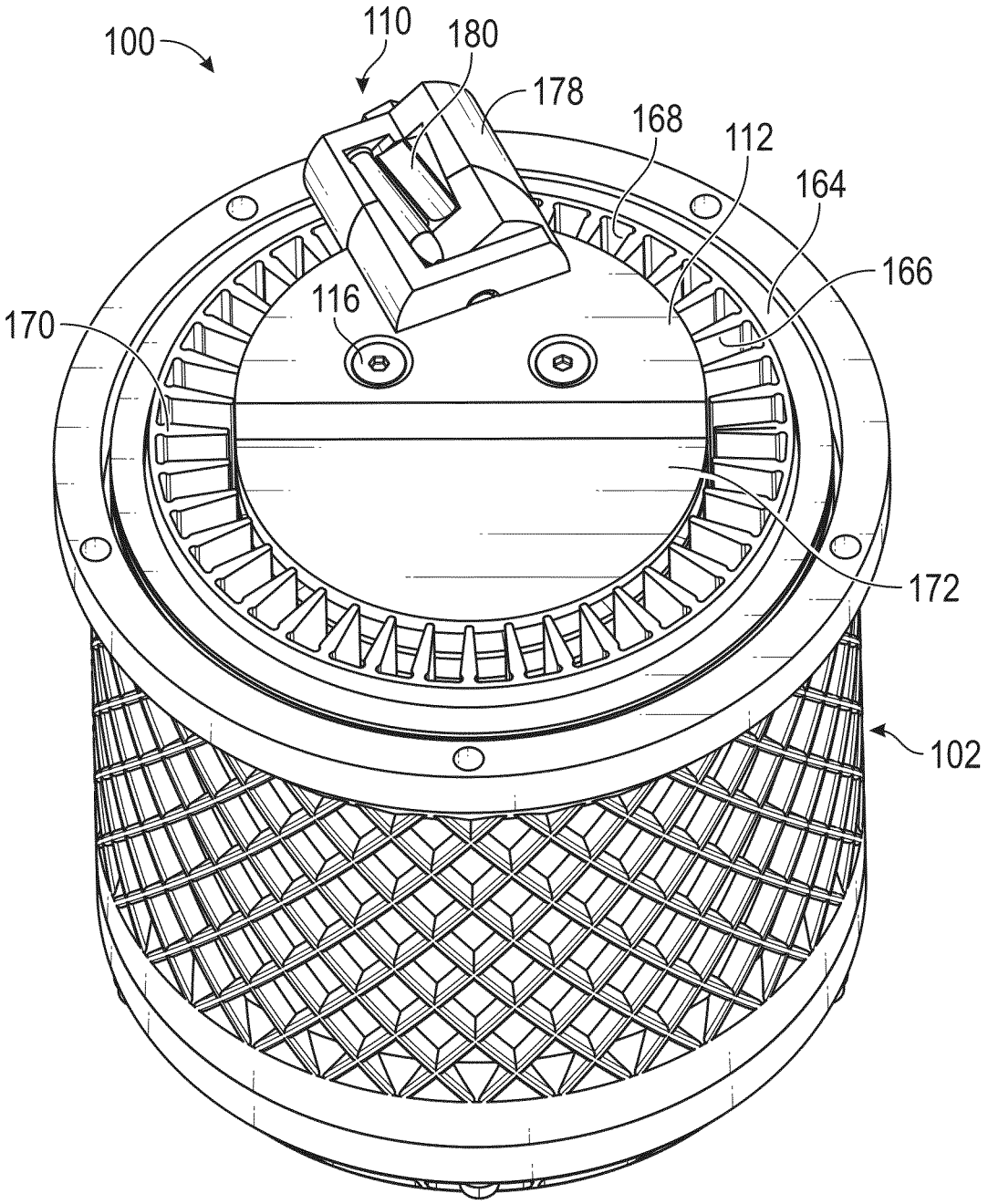
FIG. 15 shows a top perspective view of a drum magazine without a lid, in accordance with a representative embodiment.

With general reference to FIGS. 12-14, some embodiments of the drum 102 are configured such that when the outer component rotates with respect to the inner component (or vice versa), the rounds of ammunition, retained within their respective channels 168 and within their respective gaps between the tiers of the platform 176, are moved along the platform 176 (e.g., towards and into the transition drum 110). In some embodiments, this is done without any relative translational movement on the part of the channeled component 166 or the tiered component 172 (e.g., the tiered component 172 remains seated within the channeled component 166 without moving upward or downward (or vice versa, as the case may be)). In some embodiments, when the drum 102 is wound (or when the actuator is otherwise reversed), the inner and outer components of the drum 102 may rotate in an opposite direction (relative to one another) from their ordinary operative (anterograde) rotation, thereby moving rounds of ammunition in a backwards (retrograde) direction (e.g., down the spiraling platform 176). In some embodiments, retrograde movement is (or may selectively be) decoupled from winding of the spiral torsion spring 156, thereby allow for retrograde rotation without winding of the spiral torsion spring 156 or winding of the spiral torsion spring 156 without retrograde movement. In some embodiments, the drum 102 is configured such that clockwise rotation of the inner component or counterclockwise rotation of the outer component (or both) results in anterograde motion, but in some embodiments clockwise rotation of the outer component or counterclockwise rotation of the inner component (or both) results in anterograde motion (e.g., by reversing the direction of the threading of the platform 176).

Importantly, in some embodiments each round of ammunition is disposed within its own pocket in such a manner (e.g., at a proper orientation, angle, and looseness) that as the round moves along the platform 176 it operates as a bearing, thereby decreasing the resistance of the relative rotation of the channeled component 166 and the tiered component 172. Thus, with up to hundreds, thousands, or even hundreds of thousands of rounds of ammunition operating as bearings within the drum 102, the drum magazine 100 can function (e.g., rotate) smoothly and rapidly, despite the weight of so much ammunition.

In some embodiments, the tiered component 172 is configured to be selectively removed from the channeled component 166 (or vice versa) to allow for cleaning, loading, or storage.

With reference now to FIGS. 13-17, some embodiments of the drum 102 are configured such that once a round of ammunition has worked its way up the spiral, its natural motion causes it to enter the transition drum 110. Thus, the rounds can move smoothly from being stored in the drum 102 to being placed in the transition drum 110, from whence the rounds can smoothly move to the magazine well of a firearm. In some embodiments, the transition drum 110 further includes a magazine attachment (not pictured) configured to act in the same manner as a traditional firearm magazine and which can be inserted into the firearm and used to operate the firearm (which may then be constantly and rapidly replenished by the transition drum 110). In this regard, embodiments of the drum magazine 100 can be used with any firearm, and in particular any firearm with automatic or semiautomatic capabilities.

In the context of the transition drum 110, the term "cylinder" 180 refers to the name of a component and not a particular geometric shape. Accordingly, although the cylinder 180 may be generally cylindrical, it may also have any other shape that allows it (somewhat like the cylinder of a revolver) to receive a round of ammunition and shift it to a different position (e.g., at or near a top of the transition drum 110) where it can be more readily used for a firearm.

Figure 16:
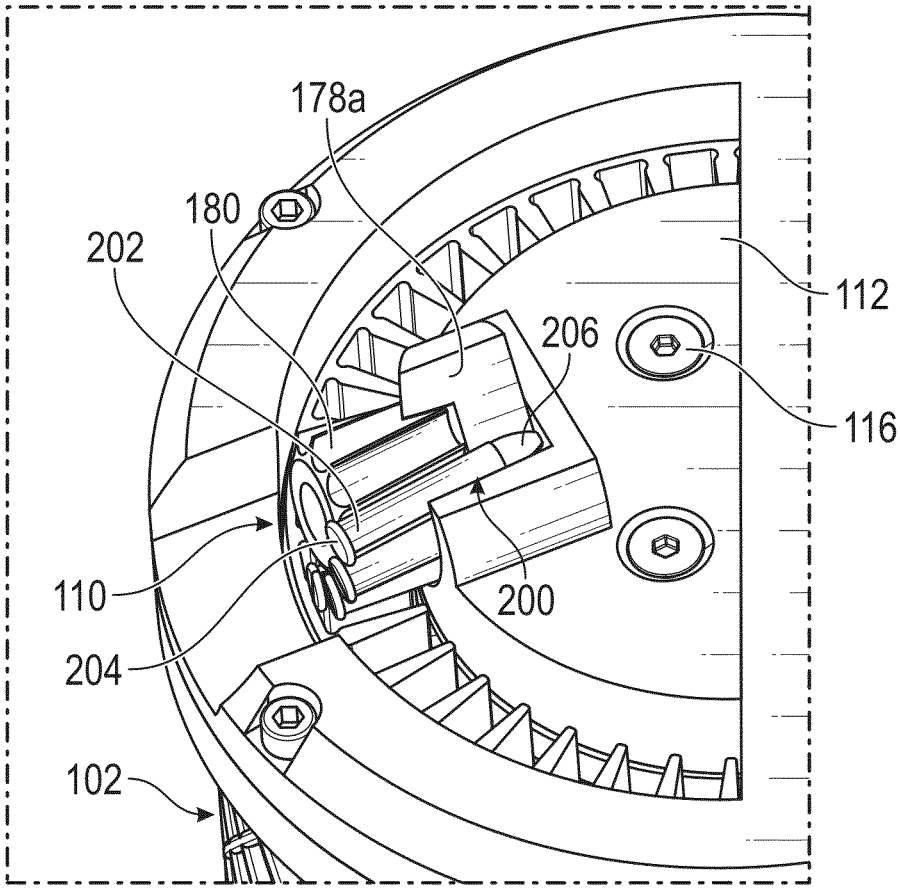
FIG. 16 shows a cutaway view of a transition drum of a drum magazine, in accordance with a representative embodiment.

Some embodiments of the cylinder 180 include one or more chambers for holding a round of ammunition. The chambers can have any configuration suitable for retaining (alone or in connection with another component (such as a transition drum housing 178)) a round of ammunition. For example, in some cases the chambers include an elongated generally-U-shaped passage configured to fit with the casing of a round of ammunition (e.g., casing 202 of a round of ammunition 200 as shown in FIG. 16).

Although the cylinder 180 can have any number of chambers, in some embodiments the cylinder has between 3 and 24 chambers (or any subrange thereof, such as 6-18, 8-16, 10-14, 12, or any other number or subrange between 3-24). In some embodiments the cylinder 180 is configured such that when a round enters a chamber from the drum 102, the inertia of the round entering the chamber causes the cylinder 180 to rotate. In some embodiments, the cylinder 180 is configured to rotate just enough (when a round enters it) to shift the next chamber of the cylinder 180 into a position where another round of ammunition can enter it from the drum 102. In some embodiments, the cylinder 180 is configured (e.g., weighted, shaped, or otherwise configured) to be biased toward a position in which a round can smoothly enter a chamber from the drum 102). For example, some embodiments of the cylinder 180 are configured not to come to rest in a position between chambers, but to naturally rotate to a position from which it can be loaded from the drum 102. In some embodiments, the chambers are closely spaced such that a round of ammunition will enter one chamber or another and not get stuck between chambers. In some embodiments, the cylinder 180 is configured to shift exactly one position (from one chamber to the next chamber) when a round of ammunition enters the chamber.

It is worth noting that by configuring the cylinder 180 to be operated by the motion of the rounds driven by the rotation of the inner and outer components of the drum 102, the cylinder 180 generally does not shift if a round is missing from one of the spaces (e.g., from a specific channel 168 at a specific tier of the platform 176). Thus, in such embodiments, a missing round does not affect the drum magazine's 100 operation or cause jamming or other problems. It is worth mentioning that in some embodiments the rotation of the cylinder 180 may be directly coupled to the rotation of the drum 102 (e.g., via a gear or another similar mechanism), but in many embodiments this is not necessary (e.g., the cylinder 180 is not directly mechanically coupled with the drum 102 by default, but is only mechanically connected when rounds of ammunition are entering the cylinder 180 from the drum 102). Thus, in some embodiments, the rounds of ammunition act somewhat like cogs in transferring the rotational energy of the drum 102 to the cylinder 180.

In some embodiments, the transition drum includes a transition drum housing 178. While the transition drum housing can include any component configured to (fully or partially) house any other component of the transition drum 110, in some cases the transition drum housing 178 includes a cavity for housing the cylinder 180. In some embodiments, the transition drum housing 178 helps retain rounds of ammunition within the chambers of the cylinder 180. For example, one or more interior walls of the transition drum housing may be configured to hold the rounds of ammunition against the cylinder 180 as the rounds travel up through the rotation of the transition drum 110 in their respective chambers.

Figure 17:
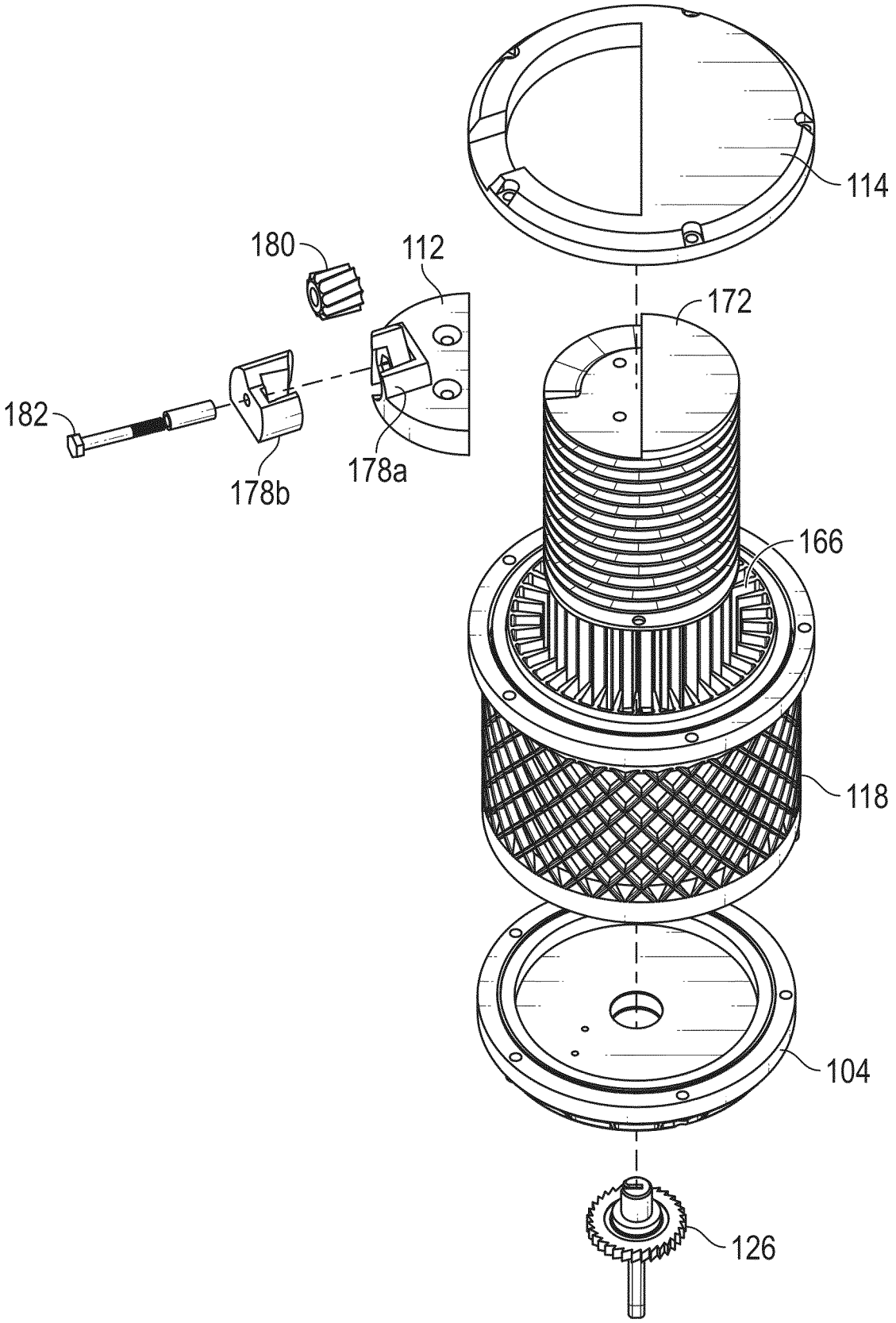
FIG. 17 shows a top perspective exploded view of a drum magazine, in accordance with a representative embodiment.

Although the transition drum housing can include any number of components, in some embodiments (as shown in FIG. 17) the transition drum housing can include a first section of the transition drum housing 178*a* and a second section of the transition drum housing 178*b*. In some embodiments, the first section of the transition drum housing 178*a* is coupled to (in any manner, including via a fastener or by being integrally formed with) the top plate 112. In some embodiments, the second section of the transition drum housing 178*b* is coupled to (in any manner, including via a fastener or by being integrally formed with) the lid 114. In some embodiments, such coupling is selective. In some embodiments, the lid 114 (as shown in FIG. 17) includes an indentation to accommodate the transition drum 110 (e.g., the second section of the transition drum housing 178*b*). Thus, in some embodiments, the transition drum housing 178 couples together the lid 114 and the top plate 112. Because the top plate 112 is, in some embodiments, coupled to the inner portion of the drum 102 (e.g., the tiered component 172, in some cases), this effectively anchors the inner portion of the drum 102 to the lid 114, thereby making the rotation of the inner portion fixed with respect to the lid 114 and the transition drum 102 such that rotation of the inner portion with respect to the outer portion is driven by rotation of the outer portion with respect to the transition drum 102 and the lid 114.

In some embodiments, the first section of the transition drum housing 178*a* is coupled to the second section of the transition drum housing 178*b* via a cylinder anchor 182, which may include any type of fastener (e.g., one or more nails, screws, bolts, staples, eyelets, magnets, hook-and-loop fasteners, adhesives, welds, interference fits, friction fits, tongue-and-groove connections, snaps, ties, rivets, stakes, wire ties, or any other coupler), but in some cases includes a bolt or a similar fastener inserted laterally through the respective sections of the housing. In some cases, the cylinder 180 is mounted on the cylinder anchor 182 such that the cylinder anchor 182 acts as the axis of rotation for the cylinder 180.

In some embodiments, a first side of the transition drum housing 178 includes a space between an inner wall of the transition drum housing 178 and the cylinder 180, thereby allowing rounds of ammunition to travel up the space in a chamber of the cylinder 180. In some embodiments, a second side of the transition drum housing 178 is formed close to the cylinder 180 such that rounds of ammunition do not have room to travel back down the opposite side of the cylinder 180. In some embodiments, when a round of ammunition reaches the second side of the transition drum housing 178, the round of ammunition is prevented from moving further until it is removed from the cylinder 180. In such cases, the cylinder may be prevented from rotating further, thereby preventing additional rounds from entering the cylinder, thereby preventing the drum 102 from continuing to rotate (or rather, preventing the components of the drum 102 from rotating with respect to one another). Thus, the transition drum 110 can operate as a second brake while the ammunition is not in use, and once the ammunition begins to be used (e.g., by the firearm), this frees up space in the cylinder 180 so that the cylinder 180, and consequently, the drum 102, can continue their operation. In some embodiments, the second side of the transition drum housing 178 includes a sloped face to cause rounds of ammunition that contact the face to be ejected from the cylinder 180 (e.g., into a magazine clip attachment, provided that there is room in such an attachment for the ammunition; if there is no room, the round of ammunition may be prevented from being ejected, thereby remaining in the cylinder 180 and stopping the process as set forth above).

With reference now to FIG. 16, some embodiments of the transition drum 110 are set at an angle with respect to the drum 102. For example, in some embodiments, at least one of the transition drum housing 178, the cylinder 180, the axis of rotation of the cylinder 180, and the cylinder anchor 182 is positioned such that it is not orthogonal to the circumference of the drum 102. In some embodiments, the transition drum 110 or any of its components is between 1 and 80 degrees (or any subrange thereof, such as between 2 and 45 degrees, 3 and 30 degrees, 4 and 20 degrees, 10 degrees±5 degrees, or any other subrange thereof) offset from orthogonal to the circumference of the drum. In some embodiments, the angle of offset (e.g., of the axis of rotation of the cylinder) is fixed, whereas in some embodiments it is selectively adjustable. According to some embodiments, the angle of offset is sufficient to ensure that the rounds of ammunition 200 are offset from one another and do not line up on each other to cause jamming. For example, as shown in FIG. 16, in some embodiments the angle of offset is sufficient to ensure that the primer 204 of each round of ammunition 200 in the cylinder 180 is disposed just ahead of the primer 204 of the following round of the ammunition 200, while still allowing the casings 202 and bullets 206 of the rounds to be in close proximity and similar orientation to one another, thereby allowing them to be rapidly fed into a firearm and deployed.

Similar to the foregoing paragraph, in some embodiments the cylinder 180 itself is skewed or its chambers are angled to cause the rounds of ammunition 200 to be slightly offset from each other. In this regard, the angle of skew of the cylinder 180 or the angle of the channels thereof can be any angle, such as anywhere from 1-80 degrees or any subrange thereof (see examples of subranges above). Thus, the channels may be disposed chordal to the faces of the cylinder 180 as opposed to orthogonal. In some embodiments, an angle of one or more components (e.g., the cylinder 180 or channels thereof) is used together with an angle of offset of the transition drum 110 as a whole, the transition drum housing 178, the cylinder anchor 182, or the axis of rotation of the cylinder 180, in order to ensure that the rounds of ammunition do not inhibit each other at any point (thereby resisting or preventing jamming) while transitioning from the drum 102 to the transition drum 110 and eventually to the firearm.

Figure 18:
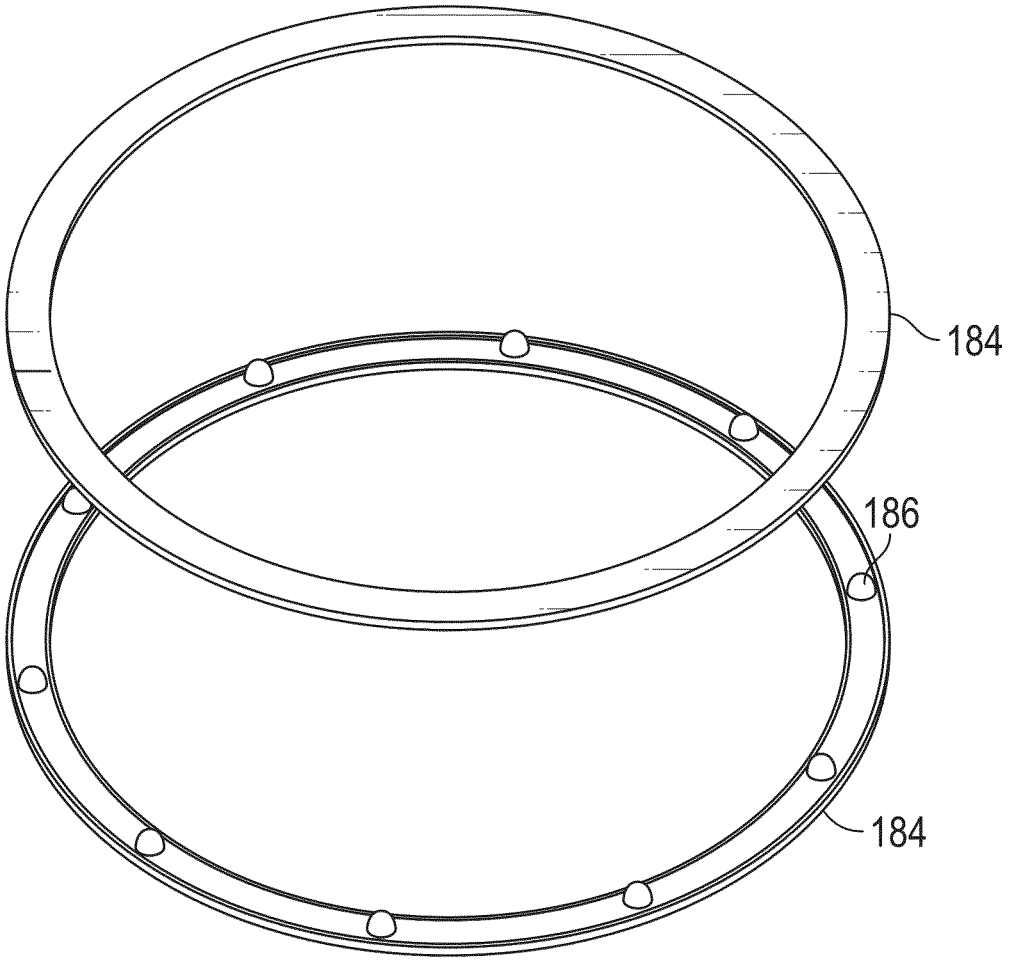
FIG. 18 shows an exploded view of a bearing, in accordance with a representative embodiment.

The drum magazine 100 or any of its individual components (e.g., the drum 102, the base 104, the body 106, the top 108, the transition drum 110, the top plate 112, the lid 114, the fastener 116, the shell 118, the bottom 120, the base plate 122, the access port 124, the winder 126, the bottom shell 128, the handle 130, the brake 132, the ratchet 134, the pawl 136, the activator 138, the coil spring 140, the gear 142, the shaft 144, the retainer 146, the walls of the groove 148, the flange 150, the winder bearing 152, the spring cover 154, the spiral torsion spring 156, the spring housing 158, the spring stop 160, the walls of the access slot 162, the drum bearing 164, the channeled component 166, the walls of the channels 168 (i.e., the dividers 170), the tiered component 172, the support 174, the platform 176, the transition drum housing 178, the cylinder 180, the cylinder anchor 182, or any of the subcomponents discussed herein which may or may not have their own reference numbers (such as a bearing housing 184, a ball bearing 186, the inner portion of the drum 102, the outer portion of the drum 102, the first side of the transition drum housing 178, the second side of the transition drum housing 178, or any other subcomponent) can be made out of any suitable material or materials, whether the same materials as any other component or different materials from any other component. In some embodiments, a light material with a low friction coefficient is used. In some embodiments, components are formed of one or more of wood, metal, glass, plastic, carbon fiber, polymer material, cardboard, paper, nylon, fabric, or any other material. Some embodiments of components are formed of multiple materials. For example, a bearing (e.g., the winder bearing 152 or drum bearing 164), as shown in FIG. 18, may include one material for a bearing housing 184 and a second material for ball bearings 186 disposed within the housing. In some embodiments, one or more components includes a transparent or translucent material (for example, the drum 102, the lid 144, the bottom 120, the transition drum housing 178, or another component may include a see-though material, allowing as user to visually ascertain the amount of remaining ammunition, the current state of the actuator (e.g., wound vs. partially wound vs. unwound), or the status of any other component.

Some embodiments include one or more methods of operating a drum magazine 100 (such as the drum magazine 100 of any embodiments discussed herein) or methods of operating a firearm using a drum magazine 100.

In some embodiments, the method includes obtaining a drum magazine 100. According to some embodiments, obtaining a drum magazine 100 may include purchasing, leasing, creating, manufacturing, assembling, or otherwise obtaining the drum magazine 100 in any manner. In some embodiments, the drum magazine 100 includes particular components, such as any of the components discussed herein arranged in any configuration discussed herein. In some embodiments, obtaining the drum magazine 100 includes obtaining (e.g., manufacturing, creating, or otherwise obtaining), assembling, or coupling together any component to form any configuration discussed herein. By way of non-limiting illustration, some embodiments of the method include: coupling a drum 102 to a transition drum 110; assembling a transition drum 110 by inserting a cylinder 180 into a transition drum housing 178 and securing it with a cylinder anchor 182 (in some cases, at an angle with respect to the drum 102); placing a bottom 120 on a base 104; attaching a top plate 112 or a lid 114 to a top 108; securing together various components with fasteners 116; installing a shell 118; inserting a winder 126 into a passage formed through a base plate 122; installing a coil spring 140 or another actuator; inserting a tiered component 172 into a channeled component 166 (or vice versa); forming an access port 124 in a base plate 122; or otherwise assembling any components to form any configuration discussed herein.

In some embodiments, the method includes coupling the drum magazine 100 to a firearm. While this can be done in any suitable manner, in some embodiments the method includes coupling the transition drum 110 to the firearm. In some cases, the transition drum 110 is coupled to a magazine attachment configured to be inserted into the firearm's magazine well. Some embodiments include rapidly filling the firearm with new ammunition from the drum 102 as ammunition is expended. In some embodiments, ammunition is provided at a rate of between 1 and 100 rounds per second, or any subrange thereof (e.g., 40±25 rounds per second, 20±15 rounds per second), or any other suitable rate at which an automatic or semi-automatic weapon is capable of firing.

Some embodiments of the method include operating one or more components of the drum magazine 100 in accordance with their intended functions. For example, some embodiments include driving a rotation of the channeled component with respect to the tiered component to cause the round of ammunition to move along the platform toward and into the transition drum and subsequently into the firearm. Some embodiments include winding or otherwise powering an actuator. Some embodiments include activating the actuator.

According to some embodiments, the method includes equipping one or more units with the drum magazine 100. The units can include any suitable recreational or military units, such as one or more robotics systems; drones, such as first-person view (FPV) drones, AI-operated drones, or any other suitable type of drones; ground infantry units; ballistic counter-rocket, artillery, mortar (C-RAM) systems; active protection systems (APS), such as TROPHY APS, and other countermeasures; indirect fire protection capability (IFCP) systems; tanks; cyclists or other mounted units; naval systems; or any other mobile or stationary individuals, groups, or systems that could benefit from a jam-resistant drum magazine. In some embodiments, the drum magazine 100 is specially adapted to be better suited for any of the foregoing, such as by adjusting the size, the spring tension, the weight, the shape, or any other attributes. In some embodiments, an ergonomic design of the drum magazine 100 makes it especially suitable for counter-defense applications (e.g., C-RAM, APS).

According to some embodiments, the method includes obtaining a plurality (e.g., at least two, but potentially three, four, five, six, or any other number) of drum magazines 100 and positioning them in a balancing arrangement (such as a symmetrical distribution). In this regard, some embodiments implement a mirrored arrangement. In some cases, dual mirrored drum magazines 100 are configured to operate in a mirrored manner (for example, if a first drum magazine is configured to rotate in a clockwise direction, a second drum magazine is configured to rotate in a counter-clockwise direction). Accordingly, some embodiments implement dual mirrored gyroscopic stability to optimize the overall system. Thus, in some cases, mirrored embodiments are particularly well suited for use in connection with drones or other vehicles that could benefit from added stability.

In some embodiments, the method includes reloading the drum magazine 100. In some embodiments, the drum magazine 100 is disposable, so the method can include disposing of a spent drum magazine 100.

The method can include any other element or step as may be reasonably implemented in operating any embodiment of the drum magazine 100 as described herein.

Any and all of the components in the figures, embodiments, implementations, instances, cases, methods, applications, iterations, and other parts of this disclosure can be combined in any suitable manner. Additionally, any component can be removed, separated from other components, modified (with or without modification of like components), or otherwise altered together or separately from anything else disclosed herein.

As used herein, the singular forms "a", "an", "the" and other singular references include plural referents, and plural references include the singular, unless the context clearly dictates otherwise. For example, reference to an actuator includes reference to one or more actuators, and reference to a fastener includes reference to one or more fasteners. In addition, where reference is made to a list of elements (e.g., elements a, b, and c), such reference is intended to include any one of the listed elements by itself, any combination of less than all of the listed elements, and/or a combination of all of the listed elements. Moreover, the term "or" by itself is not exclusive (and therefore may be interpreted to mean "and/or") unless the context clearly dictates otherwise. Similarly, the term "and" by itself is not exclusive (and therefore may be interpreted to mean "and/or") unless the context clearly dictates otherwise. Furthermore, the terms "including", "having", "such as", "for example", "e.g.", and any similar terms are not intended to limit the disclosure, and may be interpreted as being followed by the words "without limitation".

In addition, as the terms "on", "disposed on", "attached to", "connected to", "coupled to", etc. are used herein, one object (e.g., a material, element, structure, member, etc.) can be on, disposed on, attached to, connected to, or otherwise coupled to another object-regardless of whether the one object is directly on, attached, connected, or coupled to the other object, or whether there are one or more intervening objects between the one object and the other object. Also, directions (e.g., "front", "back", "on top of", "below", "above", "top", "bottom", "side", "up", "down", "under", "over", "upper", "lower", "lateral", "right-side", "left-side", "base", etc.), if provided, are relative and provided solely by way of example and for ease of illustration and discussion and not by way of limitation.

The described systems and methods may be embodied in other specific forms without departing from their spirit or essential characteristics. The described embodiments, examples, and illustrations are to be considered in all respects only as illustrative and not restrictive. The scope of the described systems and methods is, therefore, indicated by the appended claims rather than by the foregoing description. All changes that come within the meaning and range of equivalency of the claims are to be embraced within their scope. Moreover, any component and characteristic from any embodiments, examples, and illustrations set forth herein can be combined in any suitable manner with any other components or characteristics from one or more other embodiments, examples, and illustrations described herein.

What is claimed is:

1. A drum magazine comprising:

a drum comprising:

a tiered component having a spiraling platform forming a plurality of interconnected platform tiers; and a channeled component having a channel configured to receive a round of ammunition; and a transition drum comprising:

a cylinder comprising a chamber configured to receive the round of ammunition from the channel, wherein the cylinder is configured to rotate in response to the round of the ammunition entering the chamber;

wherein the channeled component is configured to rotate with respect to the tiered component, and wherein a rotation of the channeled component with respect to the tiered component causes the round of ammunition to move along the platform toward the transition drum.

2. The drum magazine as recited in claim 1, wherein a long axis of the cylinder is disposed at an angle to a radius of the drum such that the long axis of the cylinder is not parallel to the radius of the drum.

3. The drum magazine as recited in claim 2, wherein the cylinder comprises an additional chamber that is not parallel to the chamber.

4. The drum magazine as recited in claim 1, wherein the platform of the tiered component extends from a support disposed at a center of a cross section orthogonal to a longitudinal axis of the drum.

5. The drum magazine as recited in claim 4, wherein the drum comprises a lid having a window that allows a user to see into the drum.

6. The drum magazine as recited in claim 5, further comprising a selectively removable base plate disposed opposite the lid.

7. The drum magazine as recited in claim 1, wherein the drum comprises an actuator configured to drive the rotation of the channeled component with respect to the tiered component.

8. The drum magazine as recited in claim 7, wherein the actuator comprises a spiral torsion spring.

9. The drum magazine as recited in claim 8, wherein the spiral torsion spring is housed within a spring housing disposed in a base of the drum.

10. The drum magazine as recited in claim 8, further comprising a winder configured to wind the spiral torsion spring.

11. The drum magazine as recited in claim 10, further comprising a passage formed in a base plate of the drum, the passage being configured to receive the winder, thereby allowing the winder to interface with and wind the spiral torsion spring.

12. The drum magazine as recited in claim 7, further comprising a brake configured to selectively limit the rotation of the channeled component with respect to the tiered component unidirectionally.

13. The drum magazine as recited in claim 12, wherein the brake comprises an activator configured to selectively engage and disengage the brake.

14. A drum magazine comprising:

a drum comprising:

a generally cylindrical body having a top, a bottom, an inner portion, and an outer portion, wherein the inner portion and the outer portion are configured to rotate with respect to each other;

an opening in the top of the body;

a transition drum disposed at the opening;

a tiered component having platform tiers; and a channeled component having a channel configured to receive a round of ammunition;

wherein a chamber configured to house the round of ammunition is formed at least partially by the channel and at least partially by a gap between adjacent platform tiers such that the round of ammunition is maintained within an individual ammunition space while moving toward the opening;

wherein when the inner portion and the outer portion rotate with respect to each other, the drum magazine is configured such that rotational motion moves the round of ammunition towards the opening while the round of ammunition remains within the chamber, then when the round of ammunition reaches the opening, the rotational motion moves the round of ammunition from the chamber to the transition drum.

15. The drum magazine of claim 14, wherein the drum magazine is configured to operate properly regardless of its orientation.

16. The drum magazine of claim 14, further comprising a shell disposed around the outer portion.

17. The drum magazine of claim 14, wherein at least one of the inner portion and the outer portion comprises a plurality of dividers defining a channel, the plurality of dividers cooperating with the platform tiers to maintain the round of ammunition within a respective individual ammunition space while allowing movement of the round of ammunition along the channel toward the opening.

18. A drum magazine comprising:

a drum comprising:

a generally cylindrical body;

a base having a base plate allowing access to an interior of the base;

a top having at least one of a top plate and a lid;

a channeled component having a plurality of channels, each being configured to hold a round of ammunition; and a tiered component having a platform arranged into a plurality of interconnected ascending tiers in a spiral;

a transition drum configured to transfer the round of ammunition from the drum to a weapon; and an actuator disposed within the base, the actuator being configured to drive a rotation of the channeled component with respect to the tiered component, the rotation being configured to move the round of ammunition along the platform and into the transition drum.

19. The drum magazine of claim 18, wherein the actuator comprises a spiral torsion spring.

* * * * *